US011078897B2

(12) United States Patent
Reeh et al.

(10) Patent No.: US 11,078,897 B2
(45) Date of Patent: Aug. 3, 2021

(54) APPARATUS FOR PUMPING FLUID

(71) Applicant: Lynntech, Inc., College Station, TX (US)

(72) Inventors: Jonathan Reeh, College Station, TX (US); Jeffrey S. Parkey, College Station, TX (US); Alan Cisar, Cypress, TX (US); Duncan Hitchens, Allen, TX (US)

(73) Assignee: Lynntech, Inc., College Station, TX (US)

( * ) Notice: Subject to any disclaimer, the term of this patent is extended or adjusted under 35 U.S.C. 154(b) by 959 days.

(21) Appl. No.: 15/015,958

(22) Filed: Feb. 4, 2016

(65) Prior Publication Data

US 2016/0208791 A1 Jul. 21, 2016

Related U.S. Application Data

(63) Continuation-in-part of application No. 12/490,759, filed on Jun. 24, 2009, now Pat. No. 9,518,577.
(Continued)

(51) Int. Cl.
*F04B 45/027* (2006.01)
*F04B 43/00* (2006.01)
(Continued)

(52) U.S. Cl.
CPC ..... *F04B 43/0054* (2013.01); *F04B 43/06* (2013.01); *F04B 45/02* (2013.01);
(Continued)

(58) Field of Classification Search
CPC ..... F04B 2203/09; F04B 2203/10; F04B 35/008; F04B 43/06; F04B 43/10;
(Continued)

(56) References Cited

U.S. PATENT DOCUMENTS 862,867 A * 8/1907 Eggleston ..... F04B 47/04 138/30
2,578,265 A * 12/1951 Saalfrank ..... F04B 43/009 417/458

(Continued)

FOREIGN PATENT DOCUMENTS

DE 2617026 A1 * 10/1977 ..... F03G 6/00
DE 2617026 A1 10/1977
DE 10136904 A1 7/2001

OTHER PUBLICATIONS

DE 2617026 English Machine Translation.

(Continued)

*Primary Examiner* — Dominick L Plakkoottam
(74) *Attorney, Agent, or Firm* — Edwin S. Flores; Chalker Flores, LLP

(57) ABSTRACT

The present invention includes an electrochemical actuator pump and method of making the same, comprising a membrane electrode assembly comprising an ion exchange membrane, a first and a second catalyzed porous electrode in contact with opposing sides of the ion exchange membrane; a first gas chamber in fluid communication with the first electrode, and a second gas chamber in fluid communication with the second electrode; and a controller for controllably reversing the polarity of a voltage source electrically coupled to the first and second electrodes, wherein the controller causes a first polarity at the first electrode to function as an anode and the second electrode to function as a cathode, wherein the first polarity simultaneously decreases the hydrogen gas pressure in the first hydrogen gas chamber and increases the hydrogen gas pressure in the second hydrogen gas chamber, with additional embodiment using MOF or Ni—H batteries.

12 Claims, 24 Drawing Sheets

Related U.S. Application Data

(60) Provisional application No. 61/076,594, filed on Jun. 27, 2008.

(51) Int. Cl.
*F04B 43/06* (2006.01)
*F04B 45/02* (2006.01)
*F04B 45/033* (2006.01)
*F04B 19/24* (2006.01)

(52) U.S. Cl.
CPC ..... *F04B 45/024* (2013.01); *F04B 45/0336* (2013.01); *F04B 19/24* (2013.01)

(58) Field of Classification Search
CPC .... F04B 45/033; F04B 45/053; F04B 45/061; F04B 45/073; F04B 47/04; F04B 47/08; F04B 47/145; F04B 9/08
USPC ..... 417/399, 401, 402, 385, 389, 472, 473
See application file for complete search history.

(56) References Cited

U.S. PATENT DOCUMENTS 2,613,607 A * 10/1952 Sheen ..... F04B 5/00 417/383
2,613,610 A * 10/1952 Saalfrank ..... F04B 43/08 417/313
2,735,369 A * 2/1956 Turvey ..... F04B 43/009 417/383
2,960,038 A 11/1960 Lupfer et al.
3,524,714 A 8/1970 Grove et al.
3,524,814 A 8/1970 Munster et al.
4,047,851 A * 9/1977 Bender ..... F04B 43/08 417/412
4,071,585 A * 1/1978 Konishi ..... F02M 7/17 261/36.2
4,163,706 A 8/1979 Horowitz et al.
4,456,568 A * 6/1984 Taifu ..... F02M 1/14 261/39.2
4,522,698 A 6/1985 Maget
4,665,747 A * 5/1987 Muscatell ..... G01L 9/0039 250/231.19
4,718,893 A * 1/1988 Dorman ..... A61M 5/14276 128/DIG. 12
4,886,514 A 12/1989 Maget
5,141,412 A * 8/1992 Meinz ..... F04B 43/086 417/473
5,149,413 A 9/1992 Maget
5,224,841 A 7/1993 Thompson et al.
5,480,292 A * 1/1996 Chevallier ..... F04B 15/04 417/393
5,542,918 A 8/1996 Atkinson
5,558,506 A 9/1996 Simmons et al.
5,573,385 A * 11/1996 Chevallier ..... F04B 15/04 417/393
6,059,546 A * 5/2000 Brenan ..... F03G 7/065 417/375
6,146,780 A 11/2000 Cisar et al.
6,167,721 B1 1/2001 Tsenter
6,224,343 B1 * 5/2001 Newcomer ..... F04B 43/084 417/118
6,345,963 B1 2/2002 Thormin et al.
6,519,317 B2 * 2/2003 Richardson ..... H05G 1/04 378/130
7,168,928 B1 1/2007 West et al.
9,518,577 B2 * 12/2016 van Boeyen ..... F04B 19/24
9,952,607 B2 * 4/2018 Reed ..... F16K 31/002
10,359,038 B2 7/2019 van Boeyen et al.
2001/0013279 A1 * 8/2001 Blalock ..... B30B 1/003 100/71
2001/0023522 A1 * 9/2001 Watson ..... H01L 21/67196 29/25.01
2003/0003343 A1 1/2003 Cisar et al.
2004/0040862 A1 3/2004 Kosek
2005/0028535 A1 * 2/2005 Poese ..... F02G 1/0435 62/6
2005/0084395 A1 4/2005 Kang
2005/0121974 A1 * 6/2005 Buschmann ..... B60T 8/409 303/122.09
2006/0068246 A1 3/2006 Matsuo et al.
2006/0068248 A1 3/2006 Ruhl
2007/0042241 A1 2/2007 Matsuo et al.
2009/0324431 A1 * 12/2009 van Boeyen ..... F04B 19/24 417/379
2010/0108534 A1 5/2010 Carlstrom, Jr. et al.
2010/0108536 A1 5/2010 Carlstrom, Jr. et al.
2010/0112381 A1 5/2010 Carlstrom, Jr. et al.

OTHER PUBLICATIONS

Cook, Timothy R., et al., "Metal-Organic Frameworks and Self-Assembled Supramolecular Coordination Complexes: Comparing and Contrasting the Design, Synthesis, and Functionality of Metal-Organic Materials," Chemical Reviews, Nov. 2, 2012, vol. 113, pp. 734-777.
Frahm, Daniela, et al., "An Interpenetrated Metal-Organic Framework and Its Gas Storage Behavior: Simulation and Experiment," Inorganic Chemistry, Jul. 25, 2011, vol. 50 (21), pp. 11,055-11,063.
Furukawa, Hiroyasu, et al., "Independent verification of the saturation hydrogen uptake in MOF-177 and establishment of a benchmark for hydrogen adsorption in metal-organic frameworks," Journal of Materials Chemistry, May 10, 2007, vol. 17, pp. 3197-3204.
Li, Jian-Rong, et al., "Metal-Organic Frameworks for Separations," Chemical Reviews, vol. 112, Oct. 6, 2011, pp. 869-932.
Linden, David, et al., Handbook of Batteries, 3rd ed., McGraw-Hill, New York, 2002, pp. 29.1-39.37.
Liu, D., et al., "Quantum Sieving in Metal-Organic Frameworks: A Computational Study," I&EC Research, vol. 51, Dec. 1, 2011, pp. 434-442.
Ma, Shengqian, et al., "Ultramicroporous Metal-Organic Framework Based on 9,10-Anthracenedicarboxylate for Selective Gas Adsorption," Inorg. Chem., vol. 46, Jul. 28, 2007, pp. 8499-8501.
Silva, B., et al., "H2 purification by pressure swing adsorption using CuBTC," Separation and Purification Technology, 118, Aug. 24, 2013, pp. 744-756.
Stock, Norbert, et al., "Synthesis of Metal-Organic Frameworks (MOFs): Routes to Various MOF Topologies, Morphologies, and Composites," Chemical Reviews, 112 (2) 933-969,(2012) 37 pp.
Tsenter, B., et al., "Electrochemical Pump for Liquid Cooling Application," Seventeenth Annual Batter Conference on Applications and Advances, 0-7803-7132-1/02, IEEE, 2002, pp. 297-301.
Wilmer, Christopher E., et al., "Large-scale screening of hypothetical metal-organic frameworks," Nature Chemistry, vol. 4, Feb. 2012, pp. 83-89.
Yang, Chi, et al., "Fluorous Metal-Organic Frameworks for High-Density Gas Adsorption," J. Am. Chem. Soc., vol. 129, Sep. 2007, pp. 15454-15455.
Zhao, D., et al., "The current status of hydrogen storage in metal-organic frameworks," Energy & Environmental Science, vol. 1, Jun. 24, 2008, pp. 222-235.
Tsenter and Velichkovsky " Electrochemical Pump for Liquid Cooling Application" XVII. The seventeenth Annual Battery Convergence on Applications and Advances, 0-7803-7132-1/02 IEEE,2002, pp. 297-301.

* cited by examiner

Dual diaphragm/bellow pump

Reciprocating dual diaphragm/bellow pump

Reciprocating dual diaphragm/bellow pump

FIG. 13
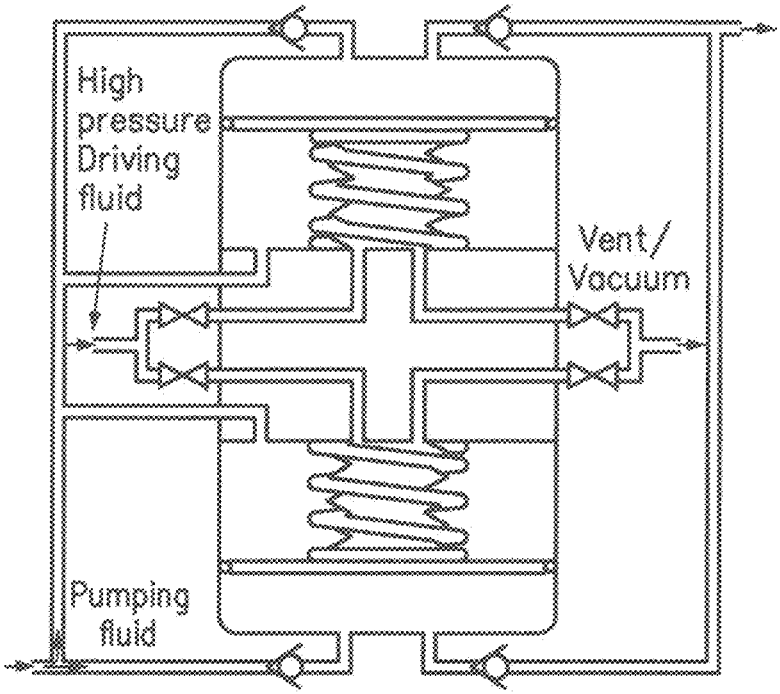
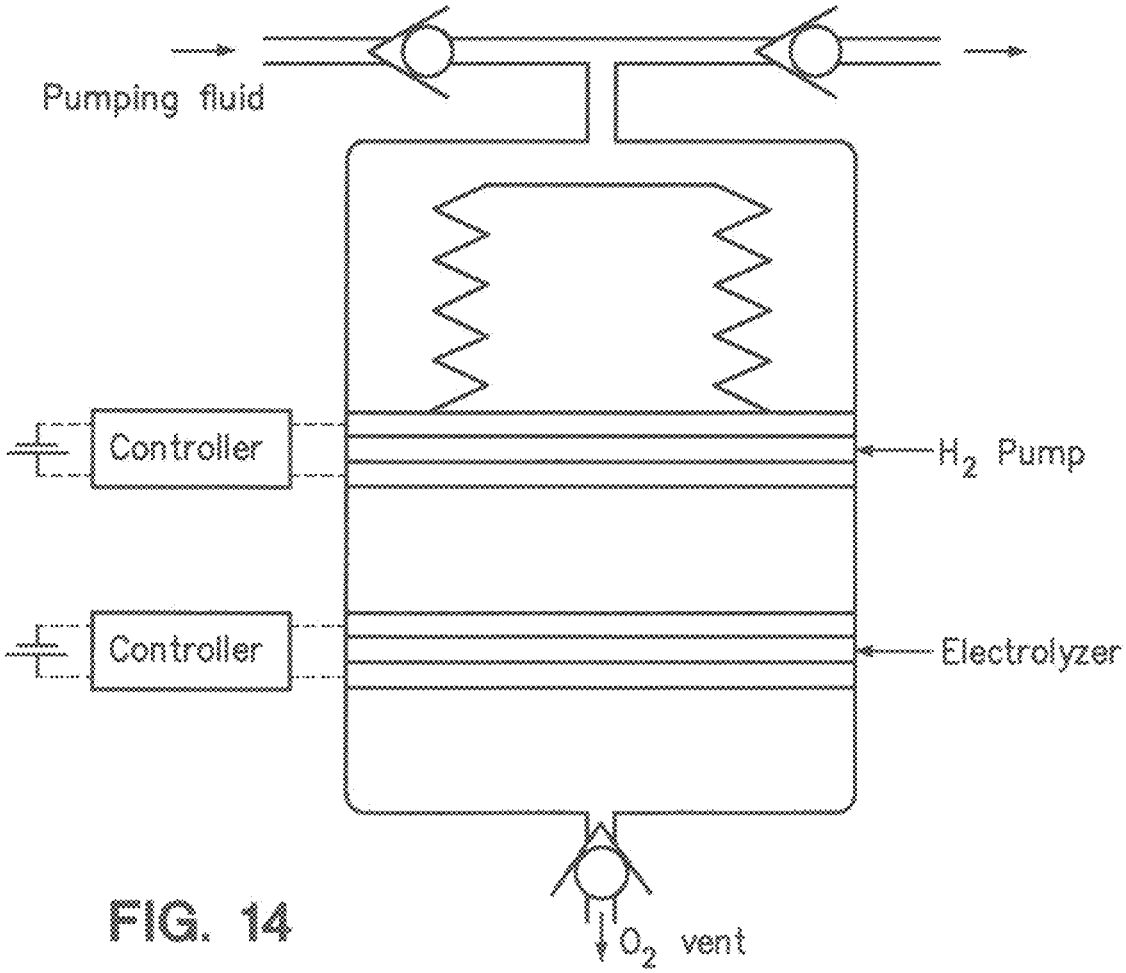
FIG. 14

APPARATUS FOR PUMPING FLUID

CROSS-REFERENCE TO RELATED APPLICATIONS

This application is a continuation and claims priority to U.S. Ser. No. 12/490,759 filed on Jun. 24, 2009, entitled "Apparatus for Pumping a Fluid," which claims priority to U.S. Provisional Application Ser. No. 61/076,594, filed Jun. 27, 2008, the entire contents of each of which are incorporated herein by reference.

STATEMENT OF FEDERALLY FUNDED RESEARCH

This invention was made with government support under contract number N00164-06-C-6051 awarded by the Department of Defense (Navy) and contract number NNM08AA06C awarded by the National Aeronautics and Space Administration (NASA). The government has certain rights in the invention.

TECHNICAL FIELD OF THE INVENTION

The present inventions relate to electrochemical cells and their use as actuators, as well as fluid-driven pump assemblies compatible with electrochemical, electrical and mechanical actuators.

BACKGROUND OF THE INVENTION

The present inventions relate to electrochemical cells and their use as actuators, as well as fluid-driven pump assemblies compatible with electrochemical, electrical and mechanical actuators.

A pump is a device that moves liquids or gases from lower pressure to higher pressure, and overcomes this difference in pressure by adding energy to the system. However, there are numerous types of pumps, each with their own advantages and disadvantages. Pumps may operate on different forms of energy, produce different flow rates and pressures, have different efficiencies, and so on. Pumps also contain numerous moving parts that cause inefficiencies, wear and occasional failures. Accordingly, it is extremely important to select an appropriate pump for a specific application. Despite the existing pumps available today, there is always a need for improved pumps that will more specifically meet the needs of existing or future applications.

SUMMARY OF THE INVENTION

One embodiment of the present invention provides a pump head operable with a driving fluid. The pump head comprises a pump housing including a moveable element that separates a driving fluid chamber from a pumping fluid chamber, an inlet check valve disposed to allow unidirectional fluid communication of a pumping fluid into the pumping fluid chamber, and an outlet check valve disposed to allow unidirectional fluid communication of the pumping fluid out of the pumping fluid chamber. The pump head also comprises first and second control valves in fluid communication with the driving fluid chamber and selectively operable to establish the driving fluid chamber in fluid communication with a driving fluid source or vacuum.

Another embodiment of the invention provides an electrochemically actuated pump. The electrochemically actuated pump comprises first and second pump housings, wherein each pump housing includes a moveable element that separates a driving fluid chamber from a pumping fluid chamber, an inlet check valve disposed to allow unidirectional fluid communication of a pumping fluid into the pumping fluid chamber, and an outlet check valve disposed to allow unidirectional fluid communication of the pumping fluid out of the pumping fluid chamber. The electrochemically actuated pump also includes an electrochemical actuator having at least one electrode fluidically coupled to the driving fluid chamber of the first pump housing and at least one electrode fluidically coupled to the driving fluid chamber of the second pump housing.

Yet another embodiment of the invention provides an electrochemical actuator. The electrochemical actuator comprises a membrane electrode assembly including an ion exchange membrane with first and second catalyzed electrodes in contact with opposing sides of the membrane, first and second current collectors in contact with the respective first and second catalyzed electrodes, a first hydrogen gas chamber in fluid communication with the first electrode, and a second hydrogen gas chamber in fluid communication with the second electrode. The electrochemical actuator also includes a controller for controllably reversing the polarity of a voltage source electrically coupled to the current collectors, wherein a first polarity causes the first electrode to function as the anode and the second electrode to function as the cathode, such that the first polarity simultaneously decreases the hydrogen gas pressure in the first hydrogen gas chamber and increases the hydrogen gas pressure in the second hydrogen gas chamber. Furthermore, a second polarity causes the first electrode to function as the cathode and the second electrode to function as the anode, such that the second polarity simultaneously increases the hydrogen gas pressure in the first hydrogen gas chamber and decreases the hydrogen gas pressure in the second hydrogen gas chamber.

One embodiment of the present invention includes an electrochemical actuator pump comprising: a membrane electrode assembly comprising an ion exchange membrane, and a first and a second catalyzed porous electrode in contact with opposing sides of the ion exchange membrane; a first gas chamber in fluid communication with the first electrode, and a second gas chamber in fluid communication with the second electrode; and a controller for controllably reversing the polarity of a voltage source electrically coupled to the first and second electrodes, wherein the controller causes a first polarity at the first electrode to function as an anode and the second electrode to function as a cathode, such that the first polarity simultaneously decreases the hydrogen gas pressure in the first hydrogen gas chamber and increases the hydrogen gas pressure in the second hydrogen gas chamber. In one aspect, the controller reverses the polarity at the first and second electrodes such that a second polarity causes the first electrode to function as the cathode and the second electrode to function as the anode, such that the second polarity simultaneously increases the hydrogen gas pressure in the first hydrogen gas chamber and decreases the hydrogen gas pressure in the second hydrogen gas chamber. In another aspect, the pump further comprises a second electrochemical actuator that simultaneously produces a high pressure at the first electrode and a vacuum at the second electrode. In another aspect, the pump further comprises a first and a second check valve, each in fluid communication with the associated with the pumping fluid chamber operate to control the direction of pumping fluid flow. In another aspect, the gas chambers are hydrogen, methane, natural gas, propane, or other gas chambers. In another aspect, the electrochemical actuator does not include a dead volume formed by separate gas diffusion layers and flow field, or does not include flow channels. In another aspect, the electrochemical actuator is in fluid communication with a gas distribution plenum and a port, wherein a first polarity draws gas into the electrochemical actuator, and a second polarity pushed gas into the port. In another aspect, the electrochemical actuator is in fluid communication with a gas distribution plenum and a port, wherein a first polarity draws gas into the electrochemical actuator, and a second polarity pushed gas into the port, and wherein the gas is driven through the membrane during a polarization cycle to drive the gas into the opposite gas chamber bidirectionally. In another aspect, a gas flow is lateral along the length of the plane of the porous electrode. In another aspect, a void volume of the fluid communication path between the first porous electrode and the first driving fluid chamber, exactly matches the void volume of the fluid communication pathway between of the second first porous electrode and the second driving fluid chamber. In another aspect, the ion exchange membrane is a perfluorosulfonic acid membrane, a proton conducting hydrocarbon membranes, a sulfonated polymeric membrane, a mechanically reinforced membrane, or a unreinforced proton conducting membranes. In another aspect, a driving fluid that drives flow through the actuator is hydrogen. In another aspect, a prime volume, which is the internal hydrogen chamber volume of one half of the pump, has a volume ratio of 3.9 to 9.0 of the total active area versus the non-active area of the ion exchange membrane. In another aspect, a displacement volume, which is the internal volume of diaphragm displacement, has a volume ratio of 4.0 to 16.0 of the total active area versus the non-active area of the ion exchange membrane. In another aspect, a pump volume, which is the internal chamber volume of one half of the pump (including dead volume) when the diaphragm is fully extended, has a ratio of 8.0 to 22.0 of the total active area versus the non-active area of the ion exchange membrane. In another aspect, an average volume, which is the total internal chamber volume during normal operation when the membrane is fully extended and the other is retracted, has a ratio between 12.0 to 28.0 of the total active area versus the non-active area of the ion exchange membrane. In another aspect, the pump is adapted for drug delivery. In another aspect, the pump has a 2, 3, 4, 5, 6, 7, 8, 9, 10, 11, 12, 20, 30, 40, 50, 60, 70, 80, 90, or 100 cell stack. In another aspect, the pump is a coolant, a heating, or a coolant/heating pump. In another aspect, the pump has a circular, square, spheroid, square, rectangular, triangular, pentagonal, hexagonal, heptagonal, octagonal, or polygonal shape. In another aspect, the pump further comprises a micropore filtration membrane for water purification. In another aspect, the pump further comprises a gas storage portion adjacent the membrane electrode assembly, wherein the gas storage comprises a metal organic framework. 33. In another embodiment, the present invention further comprises a method of assembling an electrochemical actuator pump comprising: providing a membrane electrode assembly comprising an ion exchange membrane, and a first and a second catalyzed porous electrode in contact with opposing sides of the ion exchange membrane; disposing a first gas chamber in fluid communication with the first electrode, and a second gas chamber in fluid communication with the second electrode; and connecting a controller for controllably reversing the polarity of a voltage source electrically coupled to the first and second electrodes, wherein the controller causes a first polarity at the first electrode to function as an anode and the second electrode to function as a cathode, such that the first polarity simultaneously decreases the hydrogen gas pressure in the first hydrogen gas chamber and increases the hydrogen gas pressure in the second hydrogen gas chamber.

Yet another embodiment of the present invention includes a thermally driven pump comprising a metal organic framework comprising: a vessel having an internal diameter and an inner head space, wherein the metal organic framework is positioned at an end of the vessel; and a piston within the vessel having an outer diameter that is less that the inner diameter of the vessel; a heating or cooling element that changes the temperature of the metal organic framework, wherein a gas within the metal organic framework expands when heater or contracts when cooled, pushing or pulling the piston, respectively, within the vessel. In one aspect, the gas that expands and contracts is selected such that gas a larger molecular radius reduces the rate permeation of working gas out of the pump. Another embodiment includes a method of making a thermally driven pump comprising providing a metal organic framework comprising: a vessel having an internal diameter and an inner head space, wherein the metal organic framework is positioned at an end of the vessel; and a piston within the vessel having an outer diameter that is less that the inner diameter of the vessel; a heating or cooling element that changes the temperature of the metal organic framework, wherein a gas within the metal organic framework expands when heater or contracts when cooled, pushing or pulling the piston, respectively, within the vessel.

Yet another embodiment of the present invention includes a pump driven by hydrogen comprising: a head volume of the pump in fluid communication with a hydrogen stored in a solid with a relatively low molar volume; and an electrode that charges the hydrogen in the solid state that converts the hydrogen into a gas, wherein the expanding gas pushes a piston, and wherein changing the polarity of the electrode changes the hydrogen gas back into a solid, thereby creating a vacuum that pulls the piston. In one aspect, the hydrogen is stored in a nickel-hydrogen, a nickel-metal hydride cell, or a nickel-cadmium cell. In another aspect, the electrode is a platinum, iridium, palladium, a metal. A metal allow, or an organometal. In another aspect, the pump comprises a pair of actuators. Yet another embodiment of the present invention include a method of making a pump driven by hydrogen comprising: providing a head volume of the pump in fluid communication with a hydrogen stored in a solid with a relatively low molar volume; and positioning an electrode that charges the hydrogen in the solid state that converts the hydrogen into a gas, wherein the expanding gas pushes a piston, and wherein changing the polarity of the electrode changes the hydrogen gas back into a solid, thereby creating a vacuum that pulls the piston. In one aspect, the hydrogen is stored in a nickel-hydrogen, a nickel-metal hydride cell, or a nickel-cadmium cell. In another aspect, the electrode is a platinum, iridium, palladium, a metal.

BRIEF DESCRIPTION OF THE DRAWINGS

For a more complete understanding of the features and advantages of the present invention, reference is now made to the detailed description of the invention along with the accompanying figures and in which:

FIG. 13 is a schematic diagram of a pair of pump assemblies similar to FIG. 9, except that the pumping fluid bellows has been replaced with a piston.

FIG. 14 is a schematic diagram of an electrochemical hydrogen pump with one electrode in direct communication with a driving fluid bellows, and an electrolyzer for adjusting the amount of hydrogen gas available to the electrochemical hydrogen pump.

As shown in FIG. 27, in (i) above cell b is discharging with its output augmented by a power supply to charge a, in (ii) this process is reversed.

DETAILED DESCRIPTION OF THE INVENTION

Figure 1A:
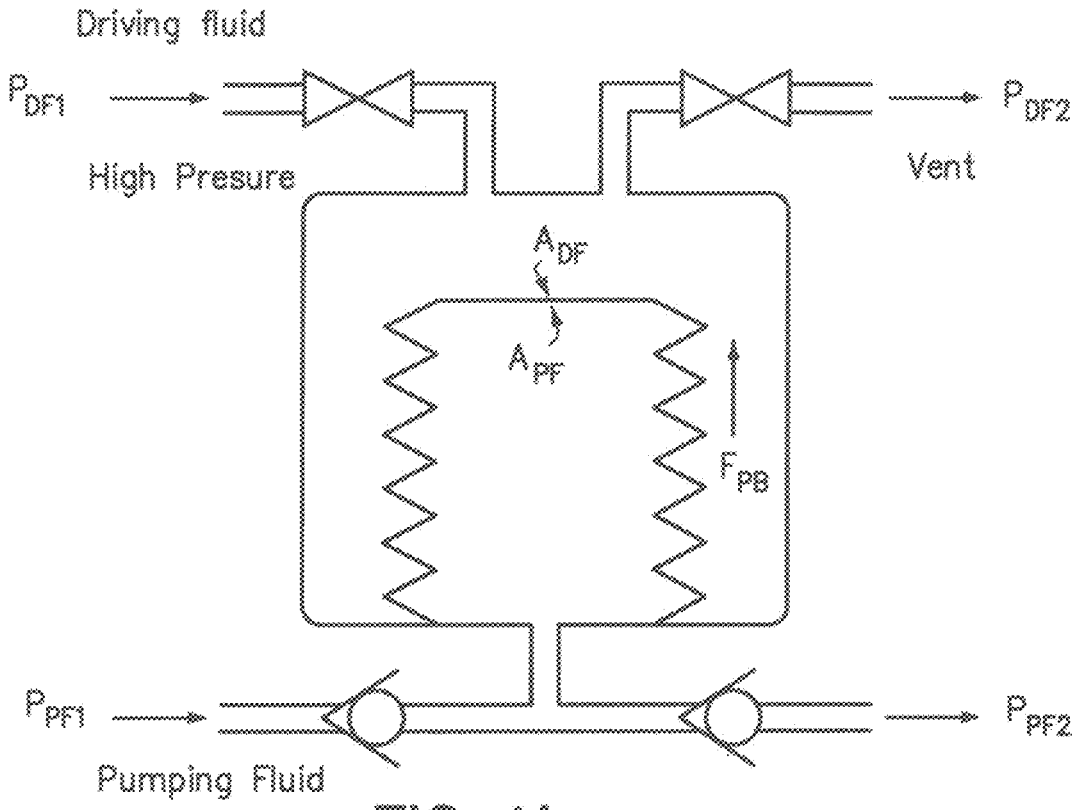
FIG. 1A (Prior Art)
FIGS. 1A and 1B are schematic diagrams of prior art (U.S. Pat. No. 3,524,714) fluid-driven pump assemblies including a bellows separating a driving fluid from a pumping fluid.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

One embodiment of the present invention provides a pump head operable with a driving fluid. The pump head comprises a pump housing including a moveable element that separates a driving fluid chamber from a pumping fluid chamber, an inlet check valve disposed to allow unidirectional fluid communication of a pumping fluid into the pumping fluid chamber, and an outlet check valve disposed to allow unidirectional fluid communication of the pumping fluid out of the pumping fluid chamber. The pump head also comprises first and second control valves in fluid communication with the driving fluid chamber and selectively operable to establish the driving fluid chamber in fluid communication with a driving fluid source, vent, or vacuum. The driving fluid source may be a pressurized liquid or gas from a mechanical pump or pressurized cylinder.

In another embodiment, the moveable element is a rigid plate, such as a metal plate. Accordingly, the driving fluid chamber may include a first expandable bellows secured and sealed between a first side of the rigid plate and a first side of the pump housing. Similarly, the pumping fluid chamber may include a second expandable bellows secured and sealed between a second side of the rigid plate and a second side of the pump housing. The pump housing itself may be open to the atmosphere or the pumping fluid around the outer surfaces of the first and second expandable bellows.

In yet another embodiment, the moveable element is a rigid plate that can be used as a stroke volume multiplier. The term "stroke volume multiplier", as used herein, means a device that enables a given volume of a first fluid (i.e., a driving fluid) to displace a larger volume of a second fluid (i.e., a pumping fluid). Accordingly, the first and second expandable bellows each have a cross-sectional area in a plane perpendicular to the axial direction of expansion and retraction, wherein the cross-sectional area inside the first expandable bellows is less than the cross-sectional area inside the second expandable bellows. The ratio of driving fluid to pumping fluid can be altered by changing the relative cross-sectional area of the driving fluid chamber and the pumping fluid chamber. The atmospheric pressure acting on the larger cross-sectional area of the pumping fluid bellows assists in pressurizing and displacing the pumping fluid from the pumping fluid bellows. In this manner, the pumping fluid pressure required to displace the pumping fluid can be reduced. The atmospheric pressure also acts to impede drawing of the pumping fluid into the pump fluid chamber, thereby requiring a reduced vent/vacuum pressure to fully expand the pumping fluid bellows.

The combined spring force of the two bellows can act either in unison or opposition to the force applied by the driving fluid. When acting in unison with the force applied by the driving fluid, the spring force of the bellows assists in pressurizing and displacing the pumping fluid from the pumping fluid chamber, thereby reducing the required driving fluid pressure. When acting in unison, the spring force of the bellows also impedes drawing of the pumping fluid into the pumping fluid chamber, thereby requiring a reduced vent/vacuum pressure.

When acting in opposition to the force applied by the driving fluid, the spring force of the bellows impedes the pressurization and displacement of the pumping fluid and assists the drawing of the pumping fluid into the pumping fluid chamber, thereby increasing the required driving fluid pressure and allowing a higher vent/vacuum pressure to be used.

It should be recognized that the bellows may be suitably substituted, in many embodiments, with another form of diaphragm, a piston, or some combination of these devices.

In a further embodiment, a spring is disposed concentric to the first expandable bellows, which contains driving fluid, between the first side of the rigid plate and a first side of the pump housing, wherein the spring biases the first expandable bellows to expand in the axial direction. In this configuration, the expansion force of the spring assists the expansion of the first expandable bellows, thereby reducing the driving fluid pressure necessary to expand the bellows. However, using a spring will also necessitate a reduced vent/vacuum to later counteract the spring force when drawing the pump fluid into the pumping fluid bellows.

The spring may also be configured within the pump to act in opposition to the force applied by the driving fluid, thereby assisting in drawing the pumping fluid into the pumping fluid chamber, thereby allowing a higher driving fluid vent/vacuum pressure. However, a spring configured in this manner will impede pressurizing and displacing of the pumping fluid from the pumping fluid chamber, thereby requiring a higher driving fluid pressure to fully contract the pumping fluid bellows.

In a still further embodiment, the second expandable bellows is secured concentrically about the first expandable bellows between the first side of the rigid plate and the first side of the pump housing. The difference in cross-sectional area still serves to multiple the stroke volume of the driving fluid, but the second expandable bellows is now positioned to assist the expansion of the first expandable bellows. Such a concentric arrangement the first and second bellows may also be combined with a concentric spring, as discussed above.

Another embodiment of the invention provides an electrochemically actuated pump. The electrochemically actuated pump comprises first and second pump housings, wherein each pump housing includes a moveable element that separates a driving fluid chamber from a pumping fluid chamber, an inlet check valve disposed to allow unidirectional fluid communication of a pumping fluid into the pumping fluid chamber, and an outlet check valve disposed to allow unidirectional fluid communication of the pumping fluid out of the pumping fluid chamber. The electrochemically actuated pump also includes an electrochemical actuator having at least one electrode fluidically coupled to the driving fluid chamber of the first pump housing and at least one electrode fluidically coupled to the driving fluid chamber of the second pump housing.

When the electrochemical actuator is not a stack, i.e., either a single cell or multiple cells physically arranged in parallel on the same side of a membrane, the at least one electrode that is fluidically coupled to the driving fluid chamber of the first pump housing preferably faces directly into the driving fluid chamber of the first pump housing and the at least one electrode that is fluidically coupled to the driving fluid chamber of the second pump housing preferably faces directly into the driving fluid chamber of the second pump housing. This arrangement reduces the "dead volume" of gases within tubes or channels.

In a preferred embodiment, the electrochemical actuator is an electrochemical hydrogen pump. Optionally, the electrochemical actuator is an electrochemical hydrogen pump stack. Regardless of the exact nature of the electrochemical actuator, it may be used in direct fluid communication with any of the pump heads discussed above. Most preferably, the electrochemical actuator is used in conjunction with two pump heads in order to take full advantage of the electrochemical actuator's ability to simultaneously produce high pressure at one electrode and a vacuum at the other electrode. Typically, the two pump heads will operate out of phase with each other, so that one pump head is receiving high pressure while the other pump is receiving vacuum pressure.

In a still further embodiment, the electrochemical actuator further comprises a controller for controllably reversing the polarity of a voltage source electrically coupled between the opposing electrodes. A first polarity simultaneously increases the hydrogen gas pressure in the driving fluid chamber of the first pump housing and decreases the hydrogen gas pressure in the driving fluid chamber of the second pump housing, and a second polarity simultaneously decreases the hydrogen gas pressure in the driving fluid chamber of the first pump housing and increases the hydrogen gas pressure in the driving fluid chamber of the second pump housing. Switching between the two polarities causes the driving fluid to move back and forth between the driving fluid chambers of the two pump housings. Each pump housing thus goes through an inlet stroke as the gas pressure in the driving fluid chamber decreases and outlet stroke as the gas pressure in the driving fluid chamber increases. The check valves associated with the pumping fluid chamber operate to control the direction of pumping fluid flow.

In a further embodiment, an electrolyzer is disposed to produce hydrogen gas into the first or second driving fluid chamber. The electrolyzer preferably produces hydrogen gas from water stored within the electrolyzer membrane. Optionally, a controller operates the electrolyzer to replace hydrogen gas that leaks out of the first and second driving fluid chambers, optionally in accordance with a gas pressure sensor or by measuring the stroke length. In an optional embodiment, a metal/air electrochemical cell or battery may be disposed to consume oxygen gas produced as a byproduct of producing hydrogen gas with the electrolyzer.

In a further embodiment, a metal hydride alloy material is disposed to store hydrogen gas within the electrochemical actuator. The hydrogen can be reversibly moved between the metal hydride and the first or second driving fluid chamber through either gas phase or electrochemical means.

Yet another embodiment of the invention provides an electrochemical actuator. The electrochemical actuator comprises a membrane electrode assembly (MEA) including an ion exchange membrane with first and second catalyzed electrodes in contact with opposing sides of the membrane, first and second current collectors in contact with the respective first and second catalyzed electrodes, a first hydrogen gas chamber in fluid communication with the first electrode, and a second hydrogen gas chamber in fluid communication with the second electrode. The electrochemical actuator also includes a controller for controllably reversing the polarity of a voltage source electrically coupled to the first and second current collectors, wherein a first polarity causes the first electrode to function as the anode and the second electrode to function as the cathode, such that the first polarity simultaneously decreases the hydrogen gas pressure in the first hydrogen gas chamber and increases the hydrogen gas pressure in the second hydrogen gas chamber, and wherein a second polarity causes the first electrode to function as the cathode and the second electrode to function as the anode, such that the second polarity simultaneously decreases the hydrogen gas pressure in the first hydrogen gas chamber and increases the hydrogen gas pressure in the second hydrogen gas chamber. In one embodiment, the electrochemical actuator includes a plurality of the membrane electrode assemblies connected electronically in series, optionally in a stack.

A stroke volume multiplier, described briefly above, may be used to yield a large reduction in hydrogen gas pressure, and thereby hydrogen flow rate and pump power draw. This is a technique that uses the atmospheric pressure to assist in pressurizing and driving the pumping fluid from pumping fluid chamber. This is implemented into the fluid pump by using a small diameter driving fluid bellows to actuate a larger diameter fluid pump bellows. In this way, the external atmospheric pressure can act on the larger cross-sectional area of the fluid pump bellows, resulting in a lower required hydrogen gas driving pressure. This is advantageous due to the significant reduction in the required hydrogen gas pressure, flow rate and pump power consumption. This technique also necessitates a lower hydrogen pressure when contracting the driving bellows to draw the pumping fluid into the pumping fluid bellows. This technique is well suited to being employed in combination with an electrochemical hydrogen pump since the stroke volume multiplier can take advantage of both the high pressure and vacuum pressure generated by the electrochemical hydrogen pump.

The electrochemical hydrogen pump current is given by $$I = \frac{2N_A}{C} N'_{H2} = \frac{2}{C} \frac{P_{H2} F_{VH2}}{kT},$$

where $N'_{H2}$ is the molar flow rate of hydrogen, $FvH_2$ is the volumetric flow rate of hydrogen, $P_{H2}$ is the hydrogen gas pressure, T is the hydrogen gas temperature, $N_A$ is Avogadro's number, C is a coulomb, and k is Boltzmann's constant.

Without the use of a stroke volume multiplier, the volumetric driving fluid (hydrogen) flow rate will equal the volumetric pumping fluid flow rate, and the hydrogen gas pressure will equal the pumping fluid pressure. The stroke volume multiplier is effective in reducing the in pump current and power draw when the output pumping fluid pressure is comparable to the atmospheric pressure. If this is the case, then with the stroke volume multiplier, the majority of the work performed by the electrochemical hydrogen pump is in displacing the pumping fluid. Without the stroke volume multiplier, a significant proportion of the work performed by the electrochemical hydrogen pump is in simply equalizing the hydrogen pressure to atmospheric pressure within the driving fluid bellows.

In addition to reducing the power consumption of the pump, the stroke volume multiplier also dramatically improves lifetime and reliability of the pump over conventional pumps by reducing the stroke frequency. Conventional reciprocating displacement pumps typically operate at high RPMs which significantly adds to kinetic loses, wear and friction. The high internal pressures that can be generated by the electrochemical hydrogen pump enable the driving fluid bellows to actuate the larger area pumping fluid bellows. The long stroke and large area of the pumping fluid bellows result in large volume displacement per stroke and a correspondingly low stroke frequency.

Figure 1B:
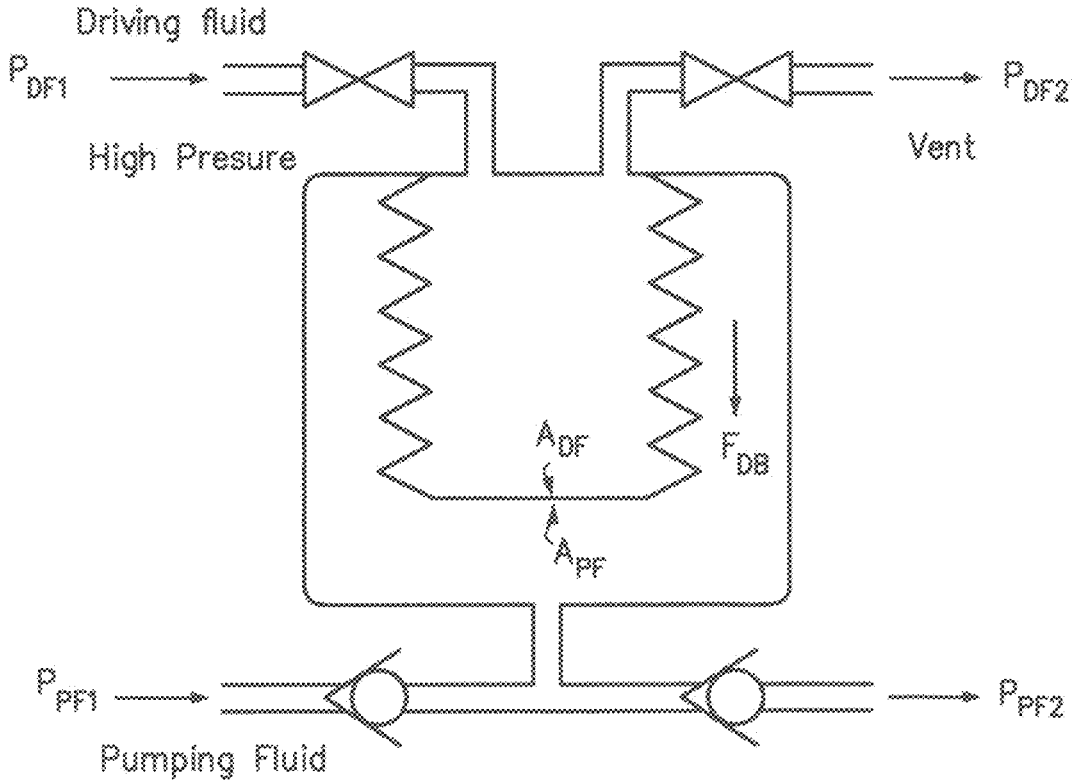
FIG. 1B (Prior Art)

FIGS. 1A and 1B are schematic diagrams of prior art (U.S. Pat. No. 3,524,714) fluid-driven pump assemblies including a bellows separating a driving fluid from a pumping fluid. The driving fluid exerts a downward force on the bellows over an area labeled $A_{DF}$ and the pumping fluid exerts an upward force on the bellows over an area labeled $A_{PF}$. The distance between the maximum compression and maximum extension of the bellows may be referred to as d. Accordingly, the following equations characterize the operation of the pump:

Driving fluid volume displaced=$V_{DF}$=d×$A_{DF}$

Pumping fluid volume displaced=$V_{PF}$=d×$A_{PF}$

For the single bellows pump, $V_{DF}$=$V_{PF}$

It is assumed that there is no 'dead volume' within the pump. With respect to FIG. 1A, this means that when the bellows is fully extended there is zero driving fluid volume in the pump and when the bellows is fully compressed there is zero pumping fluid volume in the pump. If we refer to the force exerted by the pumping bellows at its maximum compression as $F_{BP\text{-}comp}$ and the force exerted by the pumping bellows at its maximum expansion as $F_{PB\text{-}exp}$, then the following equations further characterize the operation of the pump:

Actuation Force at the Limit

Actuation Force at the limit of the pumping stroke =

$$P_{DF1} \times A_{PF} = P_{PF2} \times A_{PF} + F_{PB\text{-}comp}$$

$$\text{Actuation Pressure} = P_{DF1} = \frac{P_{PF2} \times A_{PF} + F_{PB\text{-}comp}}{A_{DF}} = P_{PF2} \frac{F_{PB\text{-}comp}}{A_{DF}}$$

$$\text{Retraction Force} = P_{DF2} \times A_{DF} = P_{PF1} \times A_{PF} + F_{PB\text{-}exp}$$

$$\text{Retraction Pressure} = P_{DF2} = \frac{P_{PF1} \times A_{PF} + F_{PB\text{-}exp}}{A_{DF}} = P_{PF1} + \frac{F_{PB\text{-}exp}}{A_{DF}}$$

Moles of Driving Gas/Pumping

Moles of driving gas/pumping volume displaced =

$$\frac{N}{V_{PF}} \propto \frac{P_{DF1} \times V_{DF}}{V_{PF}} = P_{PF2} + \frac{F_{PB\text{-}comp}}{A_{DF}}$$

Referring to FIG. 1B, the force exerted by the driving bellows at its maximum expansion is labeled $F_{dB\text{-}exp}$ and the force exerted by the driving bellows at its maximum compression is labeled $F_{dB\text{-}comp}$. Therefore, for the pump of FIG. 1B, the following equations characterize the operation of the pump:

Actuation Force at the Limit

Actuation Force at the limit of the pumping stroke =

$$P_{DF1} \times A_{DF} + F_{DB\text{-}exp} = P_{PF2} \times A_{PF}$$

$$\text{Actuation Pressure} = P_{DF1} = \frac{P_{PF2} \times A_{PF} - F_{DB\text{-}exp}}{A_{DF}} = P_{PF2} - \frac{F_{DB\text{-}exp}}{A_{DF}}$$

$$\text{Retraction Force} = P_{DF2} \times A_{DF} + F_{DB\text{-}comp} = P_{PF1} \times A_{PF}$$

$$\text{Retraction Pressure} = P_{DF2} = \frac{P_{PF1} \times A_{PF} - F_{DB\text{-}comp}}{A_{DF}} = P_{PF1} - \frac{F_{DB\text{-}comp}}{A_{DF}}$$

$$\text{Diving fluid volume displaced} = d \times A_{DF} = d \times A_{PF}$$

$$\text{Pumping fluid volume displaced} = d \times A_{PF} = d \times A_{DF}$$

Moles of Driving Gas/Pumping

Moles of driving gas/pumping volume displaced =

$$\frac{N}{V_{PF}} \propto \frac{P_{DF1} \times V_{DF}}{V_{PF}} = P_{PF2} + \frac{F_{PB\text{-}exp}}{A_{DF}}$$

Figure 2A:
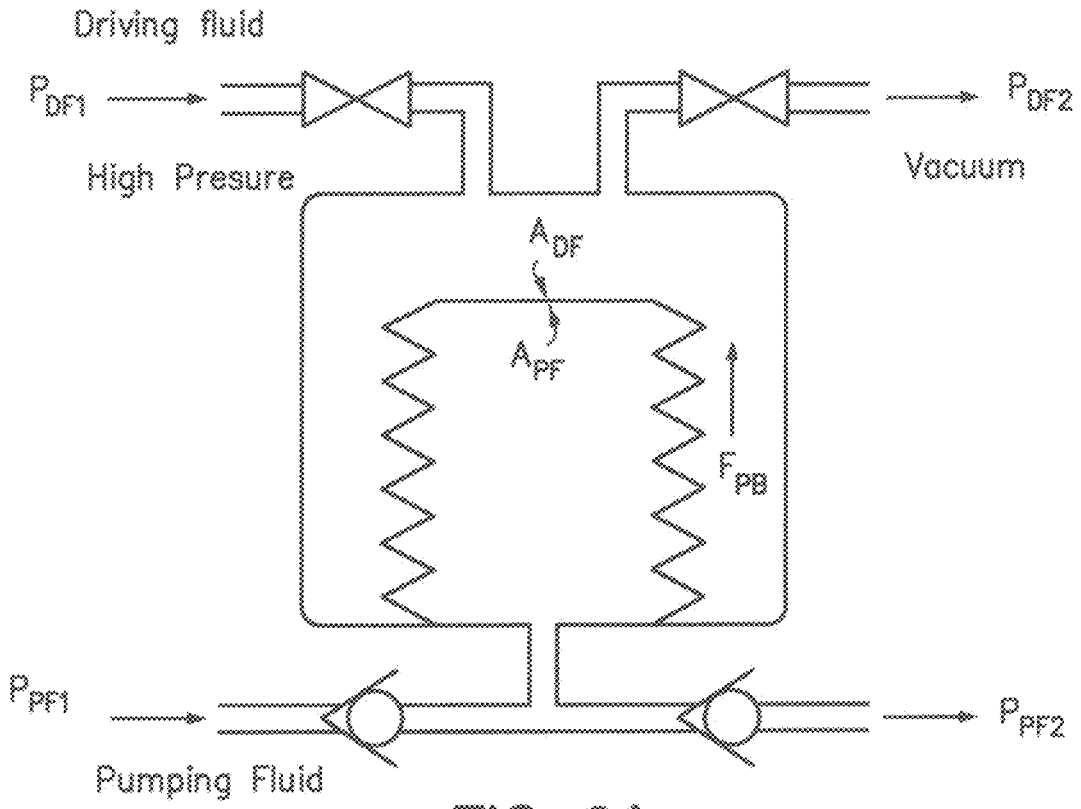
FIGS. 2A and 2B are schematic diagrams of pump assemblies including a bellows operated by a driving fluid alternating between high-pressure and vacuum pressure.
Figure 2B:
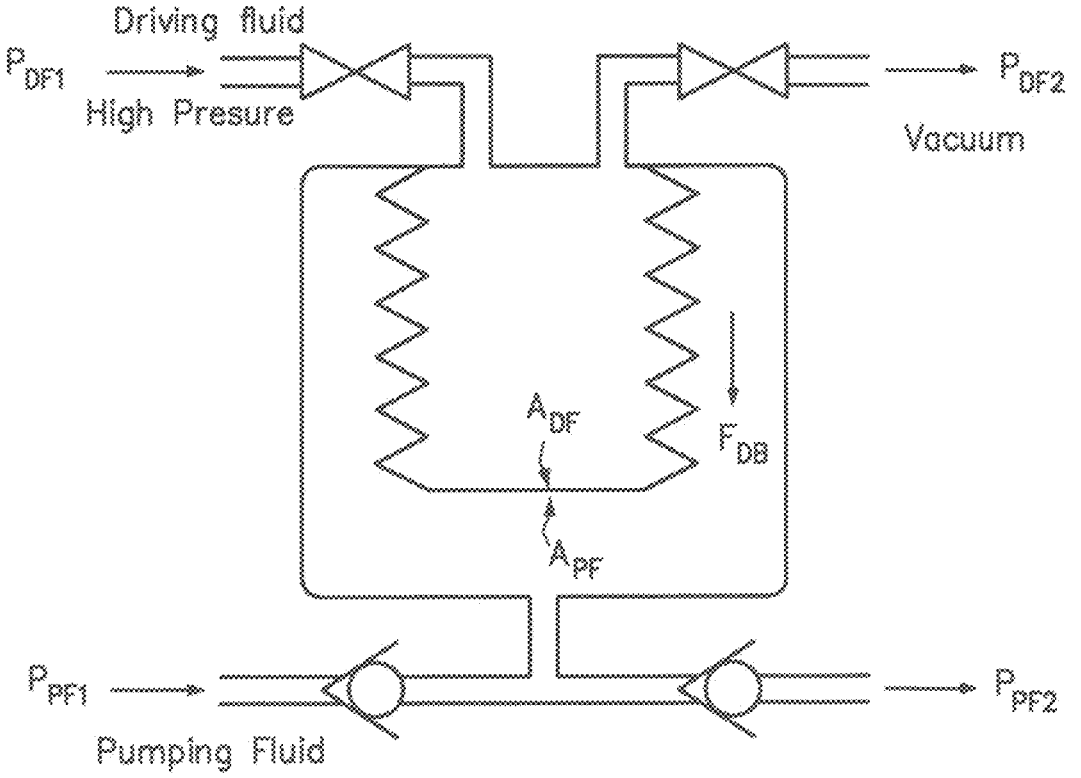

FIGS. 2A and 2B are schematic diagrams of pump assemblies including a bellows operated by a driving fluid alternating between high-pressure and vacuum pressure. Although the driving fluid is typically vented to atmosphere, i.e. the outlet pressure $P_{DF2}$ is equal to atmospheric pressure, if $P_{DF2}$ is reduced then $P_{DF1}$ can also be reduced while still retaining the same amount of pumping fluid displacement. The effect of this is to reduce the maximum expansion of the bellows and increase the maximum compression of the bellows. Reducing $P_{DF1}$ reduces the number of moles of driving gas/pumping volume displaced:

$$\frac{N}{V_{PF}} \propto \frac{P_{DF1} \times V_{DF}}{V_{PF}} = P_{PF2} + \frac{F_{PB\text{-}comp}}{A_{DF}} \quad \text{(FIG. 2A)}$$

$$\frac{N}{V_{PF}} \propto \frac{P_{DF1} \times V_{DF}}{V_{PF}} = P_{PF2} - \frac{F_{PB\text{-}exp}}{A_{DF}} \quad \text{(FIG. 2B)}$$

Typically, in a bellows pump, this is of no advantage since power savings from the reduced driving gas flow rate and pressure are more than offset by the increase in power requirements to generate the vacuum pressure. However, an electrochemical actuator can simultaneous generate both a driving pressure and vacuum pressure at no additional energy cost.

Figure 3A:
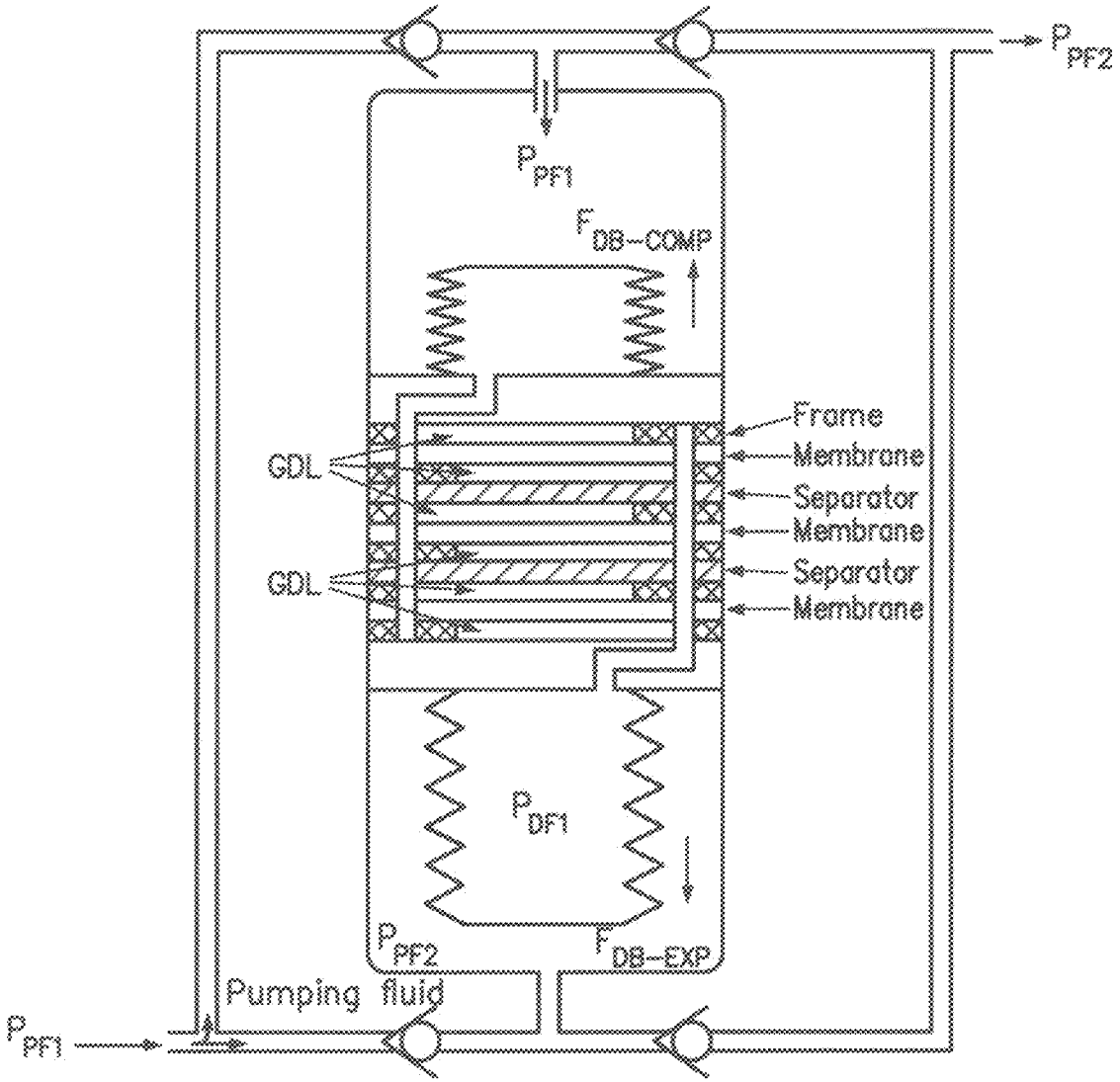
FIG. 3A is a schematic diagram of two pump assemblies according to FIG. 2B, wherein a first pump assembly has a driving fluid chamber fluidically coupled to the anode manifold of an electrochemical hydrogen pump stack and a second pump assembly has a driving fluid chamber fluidically coupled to the cathode manifold of the electrochemical hydrogen pump stack.

FIG. 3A is a schematic diagram of two pump assemblies according to FIG. 2B, wherein a first pump assembly has a driving fluid chamber fluidically coupled to the anode manifold of an electrochemical hydrogen pump stack and a second pump assembly has a driving fluid chamber fluidically coupled to the cathode manifold of the electrochemical hydrogen pump stack.

It should be recognized from FIG. 3A that the electrochemical hydrogen pump serves as the source of driving fluid and eliminates the need for a separate control valve. Rather, the amount of electronic current supplied to the electrochemical hydrogen pump controls the amount of hydrogen gas that will be introduced into the driving fluid chamber. The control valves shown in the schematic diagrams of FIGS. 1A-2B and FIGS. 4A-4B can be eliminated when an electrochemical hydrogen pump is used. Furthermore, there no need for separate high pressure and vent/vacuum ports connecting to the driving fluid chamber, since the reversal of polarity applied to the electrochemical hydrogen pump introduces and withdraws hydrogen gas through the same port.

The electrochemical actuator can be an electrochemical hydrogen pump. The electrochemical actuator comprises a membrane electrode assembly including an ion exchange membrane with first and second catalyzed porous electrodes in contact with opposing sides of the membrane, a first hydrogen gas chamber in fluid communication with the first electrode, and a second hydrogen gas chamber in fluid communication with the second electrode. The electrochemical actuator also includes a controller for controllably reversing the polarity of a voltage source electrically coupled to the current collectors, wherein a first polarity causes the first electrode to function as the anode and the second electrode to function as the cathode, such that the first polarity simultaneously decreases the hydrogen gas pressure in the first hydrogen gas chamber and increases the hydrogen gas pressure in the second hydrogen gas chamber. Furthermore, a second polarity causes the first electrode to function as the cathode and the second electrode to function as the anode, such that the second polarity simultaneously increases the hydrogen gas pressure in the first hydrogen gas chamber and decreases the hydrogen gas pressure in the second hydrogen gas chamber.

Regardless of the exact nature of the electrochemical actuator, it may be used in direct fluid communication with any of the pump heads discussed above. Most preferably, the electrochemical actuator is used in conjunction with two pump heads in order to take full advantage of the electrochemical actuator's ability to simultaneously produce high pressure at one electrode and a vacuum at the other electrode. Typically, the two pump heads will operate out of phase with each other, so that one pump head is receiving high pressure while the other pump is receiving vacuum pressure.

In a still further embodiment, the electrochemical actuator further comprises a controller for controllably reversing the polarity of a voltage source electrically coupled between the opposing electrodes. A first polarity simultaneously increases the hydrogen gas pressure in the driving fluid chamber of the first pump housing and decreases the hydrogen gas pressure in the driving fluid chamber of the second pump housing, and a second polarity simultaneously decreases the hydrogen gas pressure in the driving fluid chamber of the first pump housing and increases the hydrogen gas pressure in the driving fluid chamber of the second pump housing. Switching between the two polarities causes the driving fluid to move back and forth between the driving fluid chambers of the two pump housings. Each pump housing thus goes through an inlet stroke as the gas pressure in the driving fluid chamber decreases and outlet stroke as the gas pressure in the driving fluid chamber increases. The check valves associated with the pumping fluid chamber operate to control the direction of pumping fluid flow.

The electrochemical actuator is designed to minimize dead volume (i.e., a volume of gas in fluid connection with the electrodes that cannot be compressed beyond a certain point, as this will cause loss of efficiency). Conventional electrochemical actuators consist of several components including a current collector, flow field, gas diffusion layer (GDL), catalyst layer, and ion exchange membrane. The flow field and GDL are typically separate components with the flow field either as a discrete separate component or integrated into the current collector. The function of the GDL is to distribute the reactant gas to the catalyst layer and is typically wet-proofed to manage water. Conventional GDL's possess a high pressure drop due to small porosity requiring a low pressure drop flow field to distribute gas to the GDL. The flow field can either be a separate component or integrated into the current collector component.

Figure 3B:
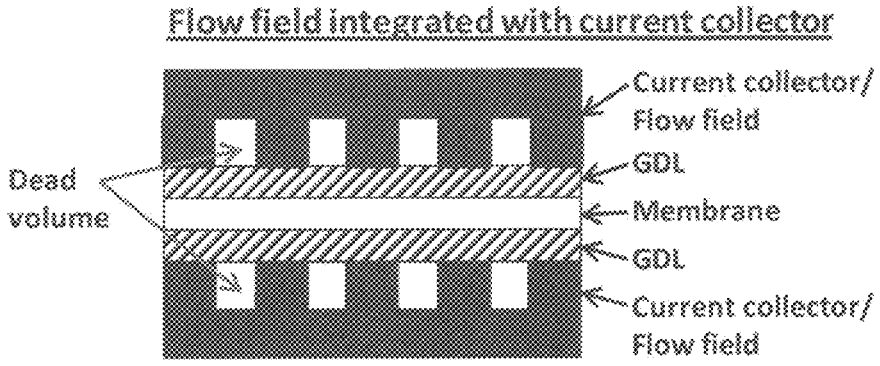
FIG. 3B (PRIOR ART)
FIG. 3B shows a conventional design where the first and second porous electrodes (e.g., GDL) and associated membrane are housed between a first and second electronically conducting current collector element, which incorporates fluid/gas flow field.
Figure 3C:
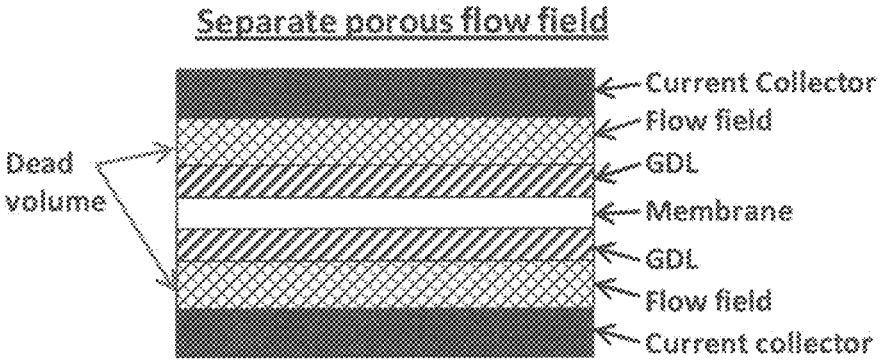
FIG. 3C (PRIOR ART)
FIG. 3C shows a first and second porous flow field of the prior art that distributes fluid to the surface of the first and second porous electrodes with a void volume.

FIG. 3B shows a conventional design where the first and second porous electrodes (e.g., GDL) and associated membrane are housed between a first and second electronically conducting current collector element, which incorporates fluid/gas flow field, i.e., flow channels. While these channels distribute fluid to the porous electrodes (e.g., GDL), this design is not preferred because channels introduce dead volume as indicated in the Figure. Also as shown in FIG. 3C shows a first and second porous flow field may be used to distribute fluid to the surface of the first and second porous electrodes (e.g., GDL). This is generally not a preferred design because it also introduces dead volume.

Figure 3D:
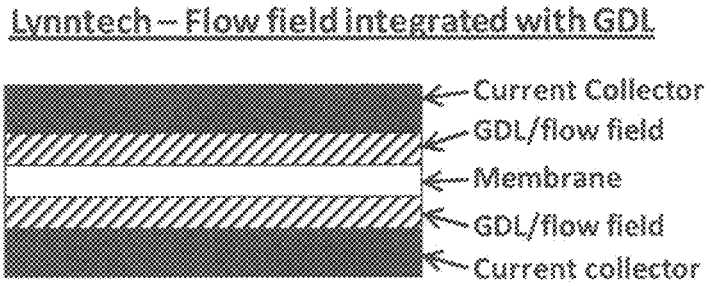
FIG. 3D shows a design that eliminates the need for a separate flow field to distribute gas/fluid the porous electrodes, wherein the first and second porous electrodes are in intimate contact with a first and second electrically conducting plate current collector with a void volume.
Figure 3E:
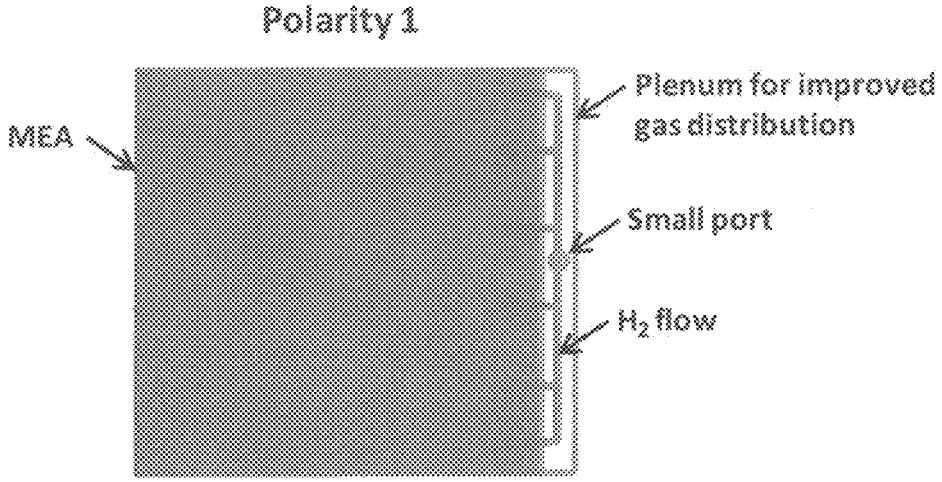
FIGS. 3E and 3F show a specific way for hydrogen to pass in and out of the porous electrode structure of the present invention.
Figure 3F:
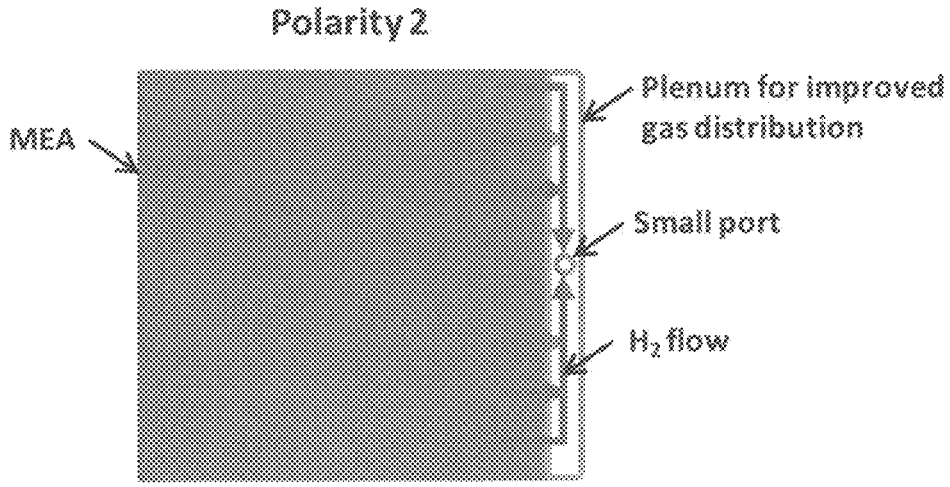

A preferred embodiment is shown in FIG. 3D, which eliminates the need for a separate flow field to distribute gas/fluid the porous electrodes, wherein the first and second porous electrodes are in intimate contact with a first and second electrically conducting plate current collector. The configuration in FIG. 3D does not have a dead volume. Moreover the porous electrode outer face is entirely sealed by the current collector. This configuration allows a specific way for hydrogen to pass in and out of the porous electrode structure as depicted in FIGS. 3E and 3F. Gas is introduced into the edge plane of the porous electrode via a plenum to improve gas distribution. During the first polarity, hydrogen passes through the small port, into plenum and is distributed into the first porous gas diffusion electrode, and then electrochemically driven across the ion exchange membrane. During the second polarity, hydrogen passes through the small port, out of the plenum and is distributed out of the first porous gas diffusion electrode, where gas distribution is via the edge.

Figure 3G:
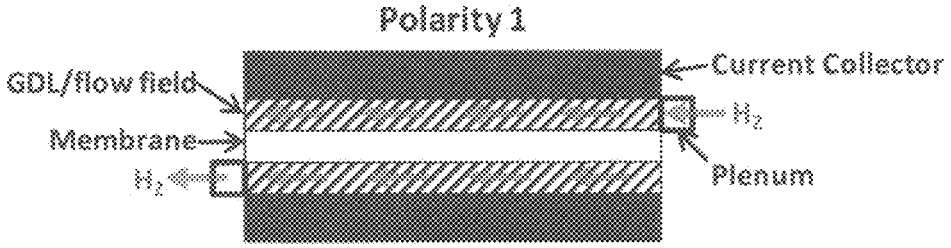
FIGS. 3G and 3H shows a cross section view of the present invention that shows novel way to achieve flow connection between the first and second porous electrodes and the first and second driving fluid chambers.
Figure 3H:
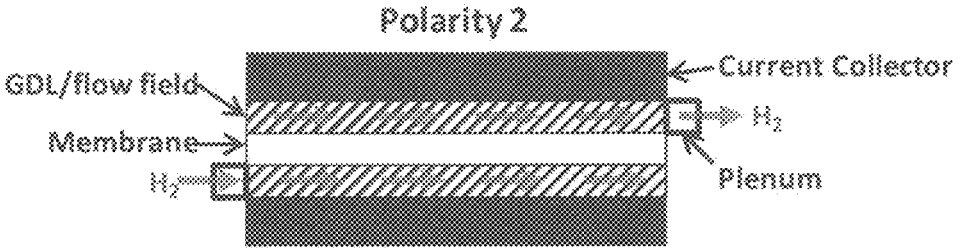

FIGS. 3G and 3H shows this arrangement in cross section views that show a novel way in which the present invention achieves flow connection between the first and second porous electrodes and the first and second driving fluid chambers. During the first polarity gas passes out from the first porous electrode into the first plenum and out through the first small port. At the same time during the first polarity, as shown in FIG. 3G, hydrogen passes in through the second small port, second plenum and is distributed into the second porous gas diffusion electrode, where gas distribution is via the porous electrode edge. During the second polarity, in FIG. 3H, gas flow is in the reverse direction from the first polarity.

The design elements described above can be used to minimize dead volume and improve efficiency for a single electrochemical actuator or a group of actuators as shown in FIG. 3A. Furthermore, these design elements (FIGS. 3D to 3H) can also be used to fabricate electrochemical actuator elements that are electrically connected in series to form a "stack" as shown in FIG. 3A, which is a schematic diagram of a two pump assembly wherein the first pump assembly has a driving fluid chamber fluidically coupled the anode manifold of an electrochemical hydrogen pump multicell stack and a second pump assembly which as a driving fluid chamber fluidically coupled to the cathode manifold of a hydrogen pump multicell stack, where pumping is achieved by cell polarity reversal. By integrating the flow field into the porous gas diffusion electrode and utilizing very small manifold channels and ports for fluidic communication between cells, the dead volume can be greatly reduced to improve efficiency. The minimum size of manifold channels and ports that can be used is defined by pressure drop and the presence of liquid water, which create clogs. If liquid water can be eliminated from the system during all aspects of storage and operation, manifolding and ports can be very small leading to decreased dead volume.

The present invention for the first time provides a pump that: (1) distributes gas bi-directional (in and out) of the porous electrodes from the edge; (2) provides a gas flow that is predominantly lateral along the plane of the porous electrode; (3) has an arrangement that achieves alternating high pressure (hydrogen gas production) and low pressure (by hydrogen gas consumption), and/or (4) has a void volume in a fluid communication path between the first porous electrode and the first driving fluid chamber, exactly matches the void volume of the fluid communication pathway between of the second first porous electrode and the second driving fluid chamber, i.e., the design is symmetrical.

Figure 4A:
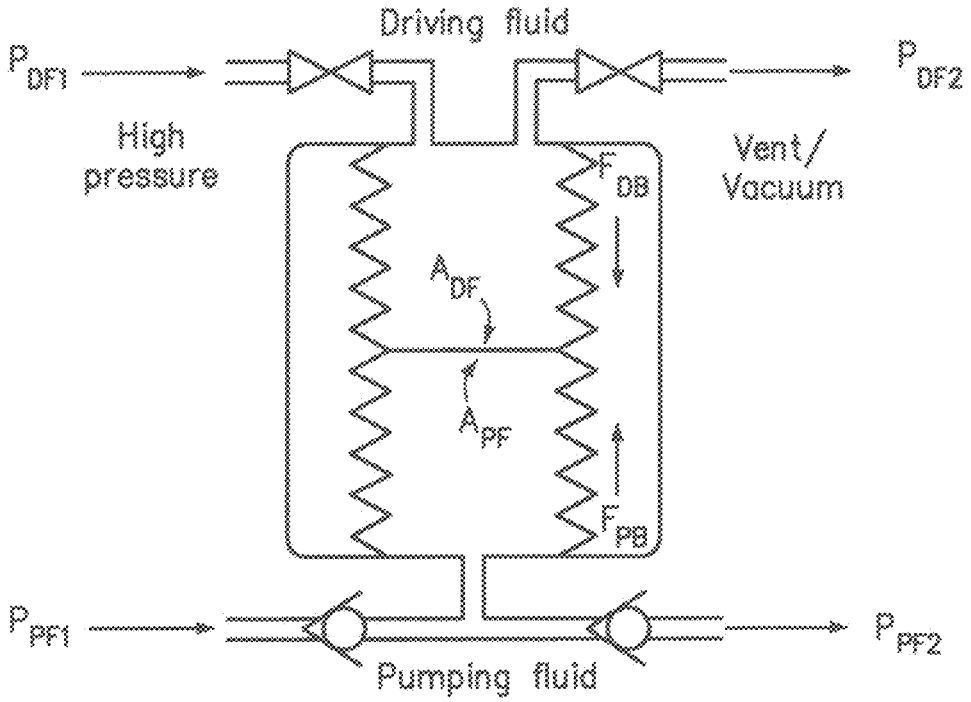
FIG. 4A (Prior Art)
FIGS. 4A and 4B are schematic diagrams of prior art (U.S. Pat. No. 862,867) fluid-driven pump assemblies including a driving fluid bellows coupled to a separate pumping fluid bellows.
Figure 4B:
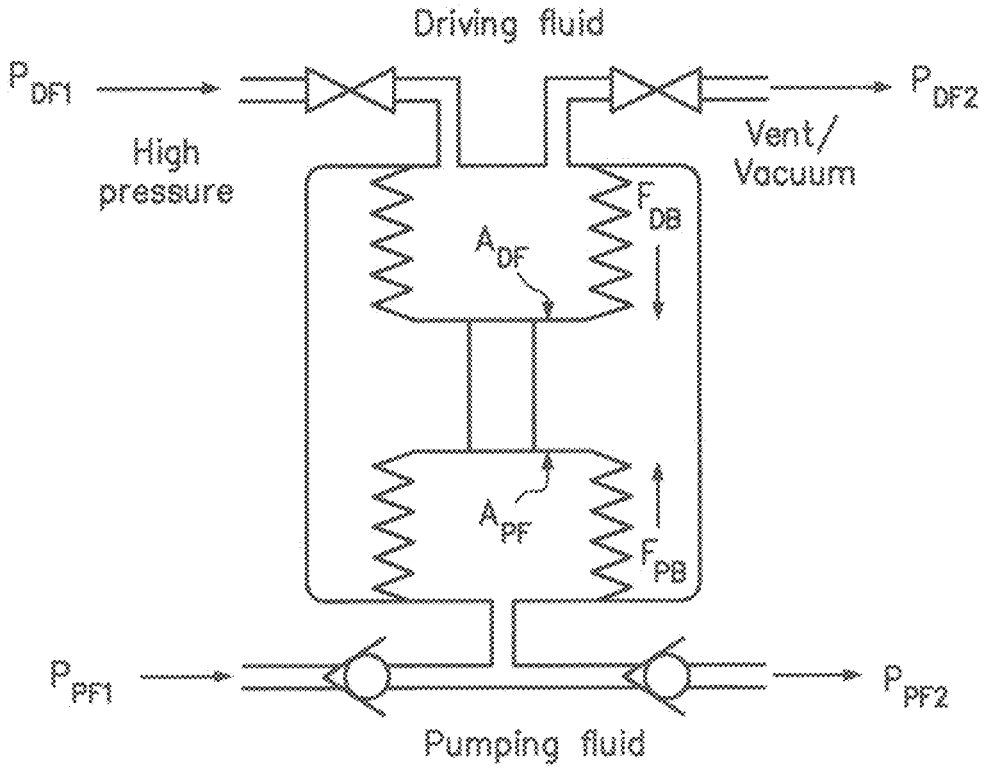
FIG. 4B (Prior Art)

FIGS. 4A and 4B are schematic diagrams of prior art (U.S. Pat. No. 862,867) fluid-driven pump assemblies including a driving fluid bellows coupled to a separate pumping fluid bellows.

Actuation Force at the limit of the pumping stroke =

$$P_{DF1} \times A_{DF} + F_{DB\text{-}exp} = P_{PF2} \times A_{PF} + F_{PB\text{-}comp}$$

$$\text{Actuation Pressure} = P_{DF1} = \frac{P_{PF2} \times A_{PF} + F_{PB\text{-}comp} - F_{DB\text{-}exp}}{A_{DF}}$$

Retraction Force = $P_{DF2} \times A_{DF} + F_{DB\text{-}comp} = P_{PF1} \times A_{PF} + F_{PB\text{-}exp}$ $$\text{Retraction Pressure} = P_{DF2} = \frac{P_{PF1} \times A_{PF} + F_{PB\text{-}exp} - F_{DB\text{-}comp}}{A_{DF}}$$

Moles of Driving Gas/Pumping

Moles of driving gas/pumping volume displaced =

$$\frac{N}{V_{PF}} \propto \frac{P_{DF1} \times V_{DF}}{V_{PF}} = P_{PF2} + \frac{F_{PB\text{-}comp} - F_{DB\text{-}exp}}{A_{DF}}$$

The opposing forces of the bellows counter-act each other. If the two bellows are identical the combined spring rate will be double the individual spring rate and the resultant bellows force will be double that experienced in FIG. 1A and FIG. 1B. To achieve the same flow rate will require a larger driving pressure, and hence a larger power consumption.

Figure 5A:
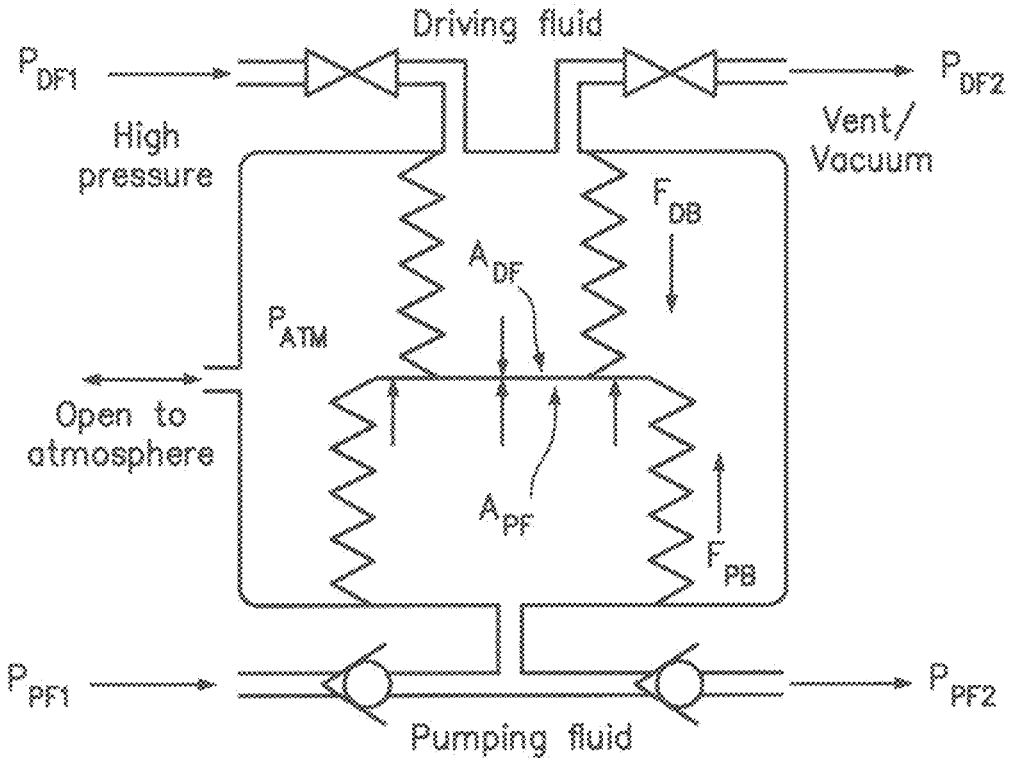
FIG. 5A is a schematic diagram of a pump assembly including a stroke volume multiplier with the atmospheric pressure assisting in pressurizing and displacing the pumping fluid from the pumping fluid chamber.

FIG. 5A is a schematic diagram of pump assembly including a stroke volume multiplier.

Actuation Force at the limit of the pumping stroke =

$$P_{DF1} \times A_{DF} + P_{Atm}(A_{PF} - A_{DF}) + F_{DB\text{-}exp} = P_{PF2} \times A_{PF} + F_{PB\text{-}comp}$$

$$\text{Actuation Pressure} = P_{DF1} = \frac{P_{PF2} \times A_{PF} - P_{Atm}(A_{PF} - A_{DF}) + F_{PB\text{-}comp} - F_{DB\text{-}exp}}{A_{DF}}$$

Retraction Force =

$$P_{DF2} \times A_{DF} + P_{Atm}(A_{PF} - A_{DF}) + F_{DB\text{-}comp} = P_{PF1} \times A_{PF} + F_{PB\text{-}exp}$$

$$\text{Retraction Pressure} = P_{DF2} = \frac{P_{PF1} \times A_{PF} - P_{Atm}(A_{PF} - A_{DF}) + F_{PB\text{-}exp} - F_{DB\text{-}comp}}{A_{DF}}$$

Diving fluid volume displaced = $d \times A_{DF}$

Pumping fluid volume displaced = $d \times A_{PF}$

Moles of driving gas/pumping volume displaced =

$$\frac{N}{V_{PF}} \propto \frac{P_{DF1} \times V_{DF}}{V_{PF}} = \frac{P_{DF1} \times A_{DF}}{A_{PF}} = P_{PF2} - P_{Atm} + \frac{P_{Atm} A_{DF}}{A_{PF}} + \frac{F_{PB\text{-}comp} - F_{DB\text{-}exp}}{A_{PF}}$$

The stroke volume results in an increase in the required driving pressure and a reduction in the number of moles of driving gas required per stroke. Typically, in a bellows pump, this is of no advantage since the power saving from the reduced driving gas flow rate is more than offset by the increase in power requirements for the higher driving fluid pressure. Compressor efficiency is typically more sensitive to pressure than flow rate. For this reason bellows pumps are typically designed to operate at low driving gas pressure and high volumetric flow rate.

Pump loses for the electrochemical actuator, on the other hand, are determined primarily by the mass flow rate. The reduction in power loses is approximately proportional to the square of the reduction in the number of moles of driving gas/pumping volume displaced. This allows for bellows pump operation at high driving pressures and low volumetric flow rates without a significant increase in power loses.

Figure 5B:
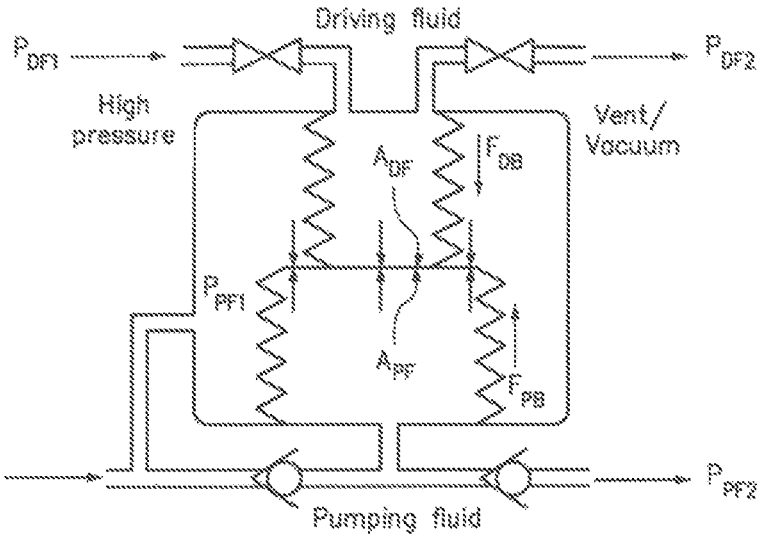
FIG. 5B is a schematic diagram of a pump assembly including a stroke volume multiplier with the pressure of the pumping fluid source assisting in pressurizing and displacing the pumping fluid from the pumping fluid chamber.

FIG. 5B is a schematic diagram of a pump assembly including a stroke volume multiplier with the pressure of the pumping fluid source assisting in pressurizing and displacing the pumping fluid from the pumping fluid chamber.

Actuation Force at the limit of the pumping stroke =

$$P_{DF1} \times A_{DF} + P_{PF1}(A_{PF} - A_{DF}) + F_{DB\text{-}exp} = P_{PF2} \times A_{PF} + F_{PB\text{-}comp}$$

$$\text{Actuation Pressure} = P_{DF1} = \frac{P_{PF2} \times A_{PF} - P_{PF1}(A_{PF} - A_{DF}) + F_{PB\text{-}comp} - F_{DB\text{-}exp}}{A_{DF}}$$

Retraction Force =

$$P_{DF2} \times A_{DF} + P_{PF1}(A_{PF} - A_{DF}) + F_{DB\text{-}comp} = P_{PF1} \times A_{PF} + F_{PB\text{-}exp}$$

$$\text{Retraction Pressure} = P_{DF2} = \frac{P_{PF1} \times A_{PF} - P_{PF1}(A_{PF} - A_{DF}) + F_{PB\text{-}exp} - F_{DB\text{-}comp}}{A_{DF}}$$

Moles of driving gas/pumping volume displaced =

$$\frac{N}{V_{PF}} \propto \frac{P_{DF1} \times V_{DF}}{V_{PF}} = \frac{P_{DF1} \times A_{DF}}{A_{PF}} = P_{PF2} - P_{PF1} + \frac{P_{PF1} A_{DF}}{A_{PF}} +$$

-continued $$\frac{F_{PB\text{-}comp} - F_{DB\text{-}exp}}{A_{PF}} = \Delta P_{PF} + \frac{P_{PF1}A_{DF}}{A_{PF}} + \frac{F_{PB\text{-}comp} - F_{DB\text{-}exp}}{A_{PF}}$$

In the case where $P_{PF1} > P_{Atm}$, a further reduction in the number of moles of driving gas/pumping volume displaced, and power consumption of the electrochemical actuator, can be gained by porting the inlet pumping pressure to the outside of the pumping bellows.

Figure 5C:
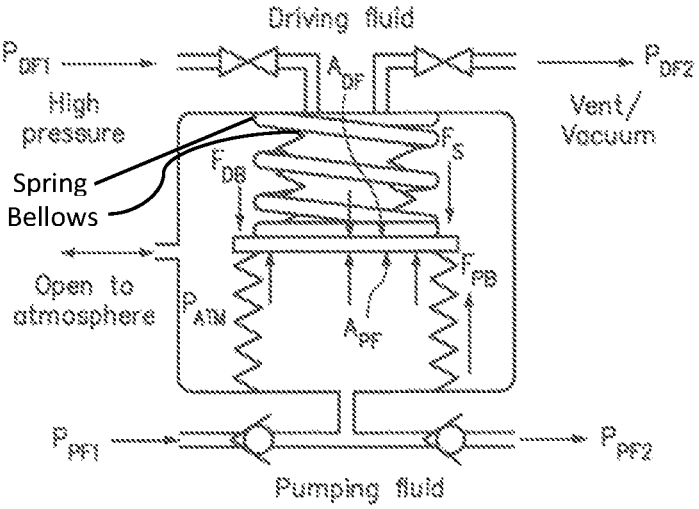
FIG. 5C is a schematic diagram of a pump assembly including a stroke volume multiplier with a spring assisting in pressurizing and displacing the pumping fluid from the pumping fluid chamber.

FIG. 5C is a schematic diagram of a pump assembly including a stroke volume multiplier with a spring assisting in pressurizing and displacing the pumping fluid from the pumping fluid chamber.

Actuation Force at the limit of the pumping stroke =

$$P_{DF1} \times A_{DF} + P_{Atm}(A_{PF} - A_{DF}) + F_{DB\text{-}exp} + F_S = P_{PF2} \times A_{PF} + F_{PB\text{-}comp}$$

$$\text{Actuation Pressure} = P_{DF1} = \frac{P_{PF2} \times A_{PF} - P_{Atm}(A_{PF} - A_{DF}) + F_{PB\text{-}comp} - F_{DB\text{-}exp} - F_S}{A_{DF}}$$

Retraction Force =

$$P_{DF2} \times A_{DF} + P_{Atm}(A_{PF} - A_{DF}) + F_{DB\text{-}comp} + F_S = P_{PF1} \times A_{PF} + F_{PB\text{-}exp}$$

$$\text{Retraction Pressure} = P_{DF2} = \frac{P_{PF1} \times A_{PF} - P_{Atm}(A_{PF} - A_{DF}) + F_{PB\text{-}exp} - F_{DB\text{-}comp} - F_S}{A_{DF}}$$

Moles of driving gas/pumping volume displaced =

$$\frac{N}{V_{PF}} \propto \frac{P_{DF1} \times V_{DF}}{V_{PF}} = \frac{P_{DF1} \times A_{DF}}{A_{PF}} == P_{PF2} - P_{Atm} + \frac{P_{Atm}A_{DF}}{A_{PF}} + \frac{F_{PB\text{-}comp} - F_{DB\text{-}exp} - F_S}{A_{PF}}$$

The effect of the spring force is to reduce the driving and vacuum pressure required and the number of moles of driving gas displaced. As previously stated, this is of no advantage to a typical bellows pump since power saving from the reduced driving gas flow rate and pressure are more than offset by the increase in power required for the lower vacuum pressure. However, with an electrochemical actuator, the reduction in power is proportional to the square of the reduction in the number of moles of driving gas required per stroke.

Figure 5D:
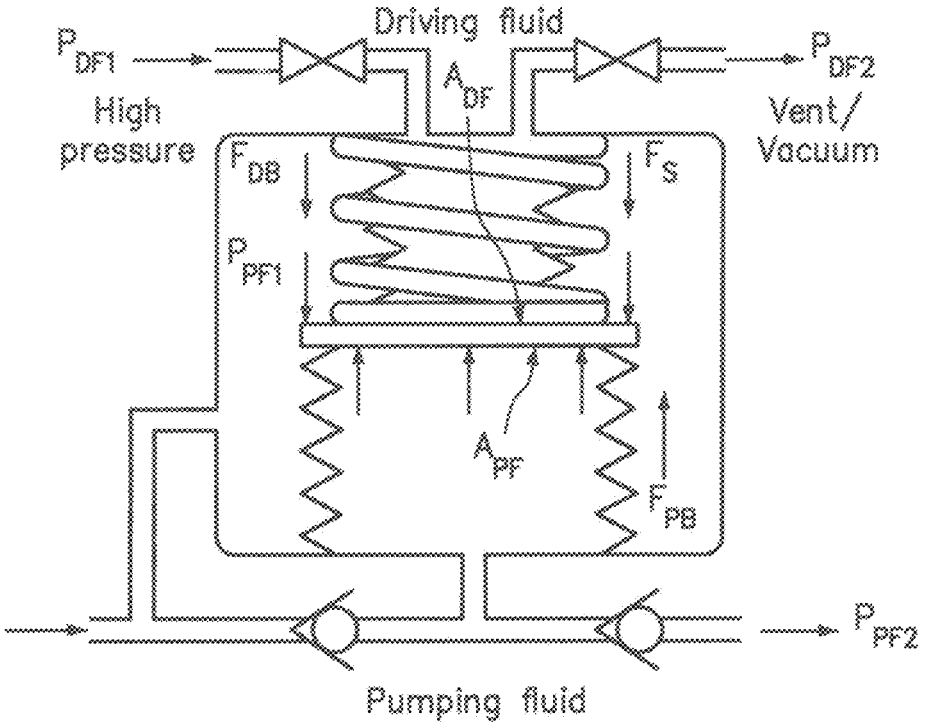
FIG. 5D is a schematic diagram of a pump assembly including a stroke volume multiplier with a spring and the pressure of the pumping fluid source both assisting in pressurizing and displacing the pumping fluid from the pumping fluid chamber.

FIG. 5D is a schematic diagram of a pump assembly including a stroke volume multiplier with a spring and the pressure of the pumping fluid source both assisting in pressurizing and displacing the pumping fluid from the pumping fluid chamber.

Actuation Force at the limit of the pumping stroke =

$$P_{DF1} \times A_{DF} + P_{PF1}(A_{PF} - A_{DF}) + F_{DB\text{-}exp} + F_S = P_{PF2} \times A_{PF} + F_{PB\text{-}comp}$$

$$\text{Actuation Pressure} = P_{DF1} = \frac{P_{PF2} \times A_{PF} - P_{PF1}(A_{PF} - A_{DF}) + F_{PB\text{-}comp} - F_{DB\text{-}exp} - F_S}{A_{DF}}$$

Retraction Force =

$$P_{DF2} \times A_{DF} + P_{PF1}(A_{PF} - A_{DF}) + F_{DB\text{-}comp} + F_S = P_{PF1} \times A_{PF} + F_{PB\text{-}exp}$$

$$\text{Retraction Pressure} = P_{DF2} = \frac{P_{PF1} \times A_{PF} - P_{PF1}(A_{PF} - A_{DF}) + F_{PB\text{-}exp} - F_{DB\text{-}comp} - F_S}{A_{DF}}$$

-continued

Moles of driving gas/pumping volume displaced =

$$\frac{N}{V_{PF}} \propto \frac{P_{DF1} \times V_{DF}}{V_{PF}} = \frac{P_{DF1} \times A_{DF}}{A_{PF}} == P_{PF2} - P_{PF1} + \frac{P_{PF1}A_{DF}}{A_{PF}} + \frac{F_{PB\text{-}comp} - F_{DB\text{-}exp} - F_S}{A_{PF}} = \Delta P_{PF} + \frac{P_{PF1}A_{DF}}{A_{PF}} + \frac{F_{PB\text{-}comp} - F_{DB\text{-}exp} - F_S}{A_{PF}}$$

Figure 6:
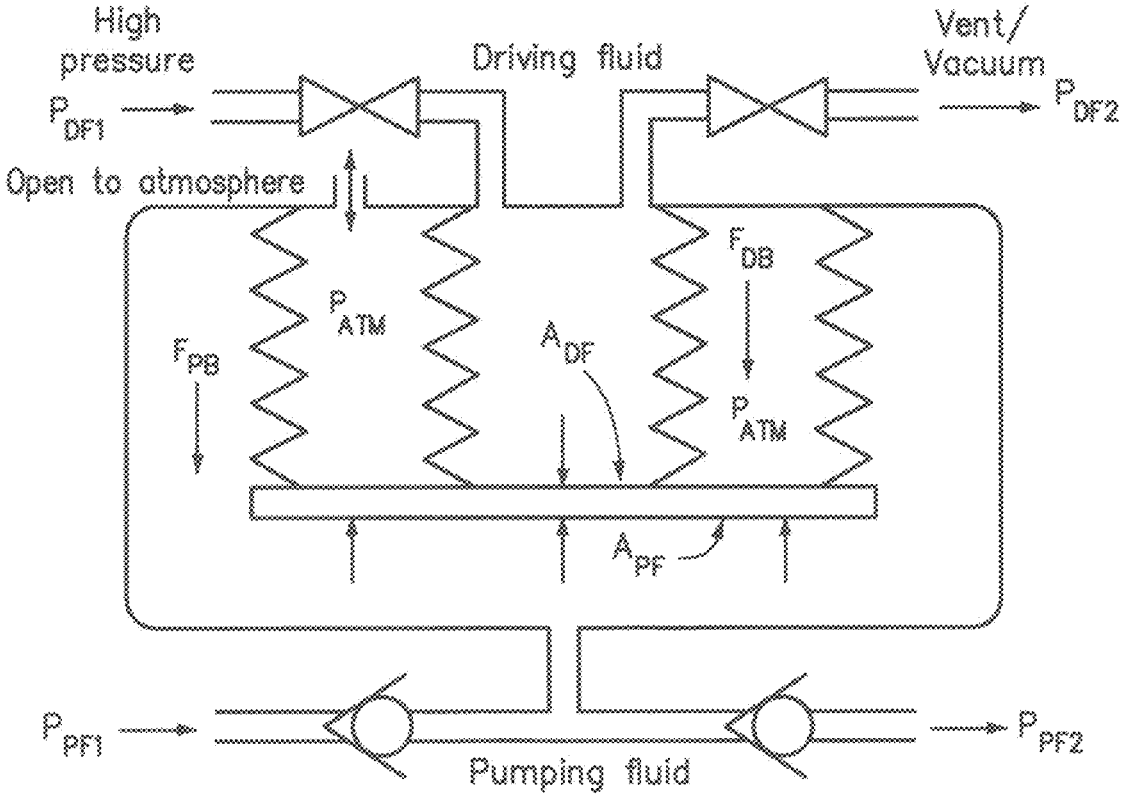
FIG. 6 is a schematic diagram of a pump assembly including a stroke volume multiplier with both the driving fluid bellows and the pumping fluid bellows concentrically disposed to assist in pressurizing and displacing the pumping fluid from the pumping fluid chamber.

FIG. 6 is a schematic diagram of a pump assembly including a stroke volume multiplier with both the driving fluid bellows and the pumping fluid bellows concentrically disposed to assist in pressurizing and displacing the pumping fluid from the pumping fluid chamber.

Actuation Force at the limit of the pumping stroke =

$$P_{DF1} \times A_{DF} + P_{Atm}(A_{PF} - A_{DF}) + F_{DB\text{-}exp} = P_{PF2} \times A_{PF} + F_{PB\text{-}exp}$$

$$\text{Actuation Pressure} = P_{DF1} = \frac{P_{PF2} \times A_{PF} - P_{Atm}(A_{PF} - A_{DF}) - F_{PB\text{-}exp} - F_{DB\text{-}exp}}{A_{DF}}$$

Retraction Force =

$$P_{DF2} \times A_{DF} + P_{Atm}(A_{PF} - A_{DF}) + F_{DB\text{-}comp} = P_{PF1} \times A_{PF} - F_{PB\text{-}comp}$$

$$\text{Retraction Pressure} = P_{DF2} = \frac{P_{PF1} \times A_{PF} - P_{Atm}(A_{PF} - A_{DF}) - F_{PB\text{-}comp} - F_{DB\text{-}comp}}{A_{DF}}$$

Moles of driving gas/pumping volume displaced =

$$\frac{N}{V_{PF}} \propto \frac{P_{DF1} \times V_{DF}}{V_{PF}} = \frac{P_{DF1} \times A_{DF}}{A_{PF}} == P_{PF2} - P_{Atm} + \frac{P_{Atm}A_{DF}}{A_{PF}} - \frac{F_{PB\text{-}exp} - F_{DB\text{-}exp}}{A_{PF}}$$

With concentric bellows, the bellows forces are acting in unison to allow the driving pressure to be further reduced, but this also requires the retraction vacuum pressure to be reduced. This in turn reduces the number of moles of driving gas required per stroke.

Figure 7:
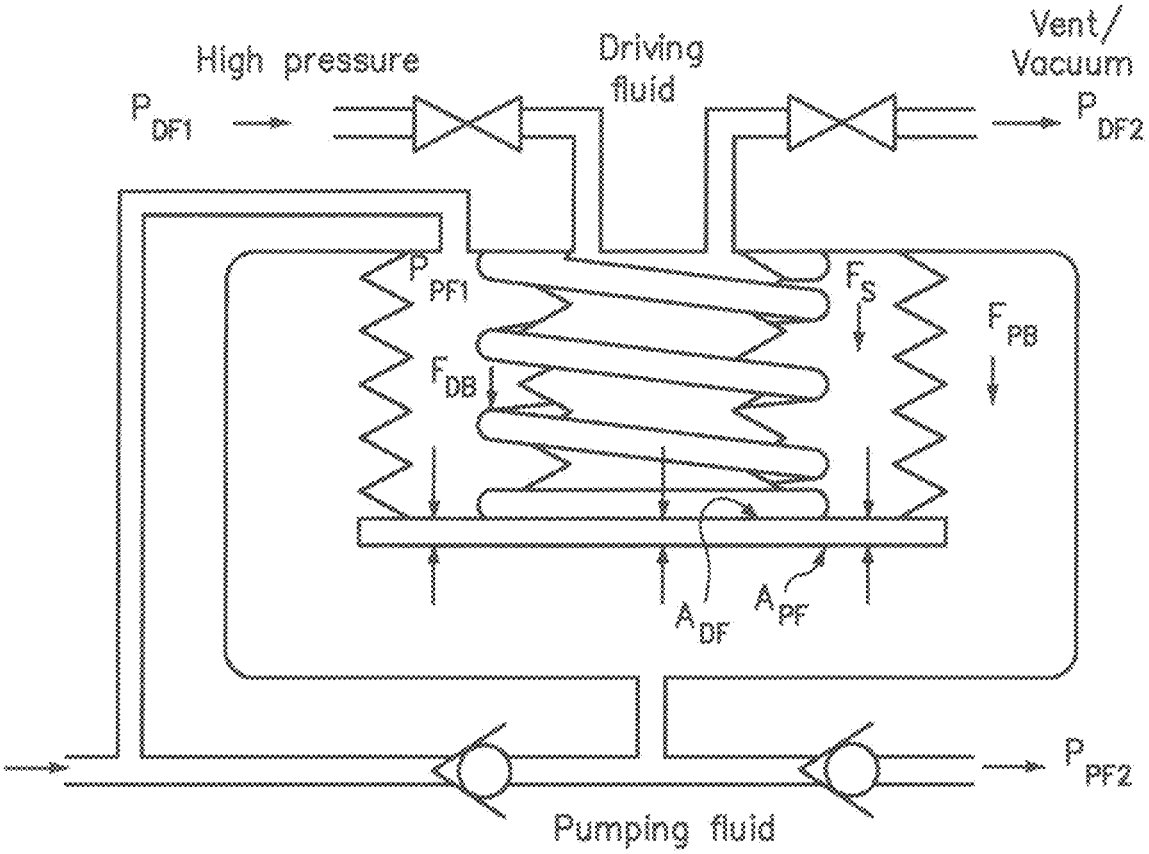
FIG. 7 is a schematic diagram of a pump assembly including a stroke volume multiplier with the driving fluid bellows, the pumping fluid bellows, a spring and the pressure of the pumping source each assisting in pressurizing and displacing the pumping fluid from the pumping fluid chamber.

FIG. 7 is a schematic diagram of a pump assembly including a stroke volume multiplier with the driving fluid bellows, the pumping fluid bellows, a spring and the pressure of the pumping source each assisting in pressurizing and displacing the pumping fluid from the pumping fluid chamber.

Actuation Force at the limit of the pumping stroke =

$$P_{DF1} \times A_{DF} + P_{PF1}(A_{PF} - A_{DF}) + F_{DB\text{-}exp} + F_S = P_{PF2} \times A_{PF} - F_{PB\text{-}exp}$$

$$\text{Actuation Pressure} = P_{DF1} = \frac{P_{PF2} \times A_{PF} - P_{PF1}(A_{PF} - A_{DF}) - F_{PB\text{-}exp} - F_{DB\text{-}exp} - F_S}{A_{DF}}$$

Retraction Force = $P_{DF2} \times A_{DF} + P_{PF1}(A_{PF} - A_{DF}) + F_{DB\text{-}comp} + F_S = P_{PF1} \times A_{PF} - F_{PB\text{-}comp}$ $$\text{Retraction Pressure} = P_{DF2} = \frac{P_{PF1} \times A_{PF} - P_{PF1}(A_{PF} - A_{DF}) - F_{PB\text{-}comp} - F_{DB\text{-}comp} - F_S}{A_{DF}}$$

-continued

Moles of driving gas/pumping volume displaced =

$$\frac{N}{V_{PF}} \propto \frac{P_{DF1} \times V_{DF}}{V_{PF}} = \frac{P_{DF1} \times A_{DF}}{A_{PF}} = \Delta P_{PF2} + \frac{P_{PF1} A_{DF}}{A_{PF}} - \frac{F_{PB\text{-}exp} + F_{DB\text{-}exp} + F_S}{A_{PF}}$$

Figure 8:
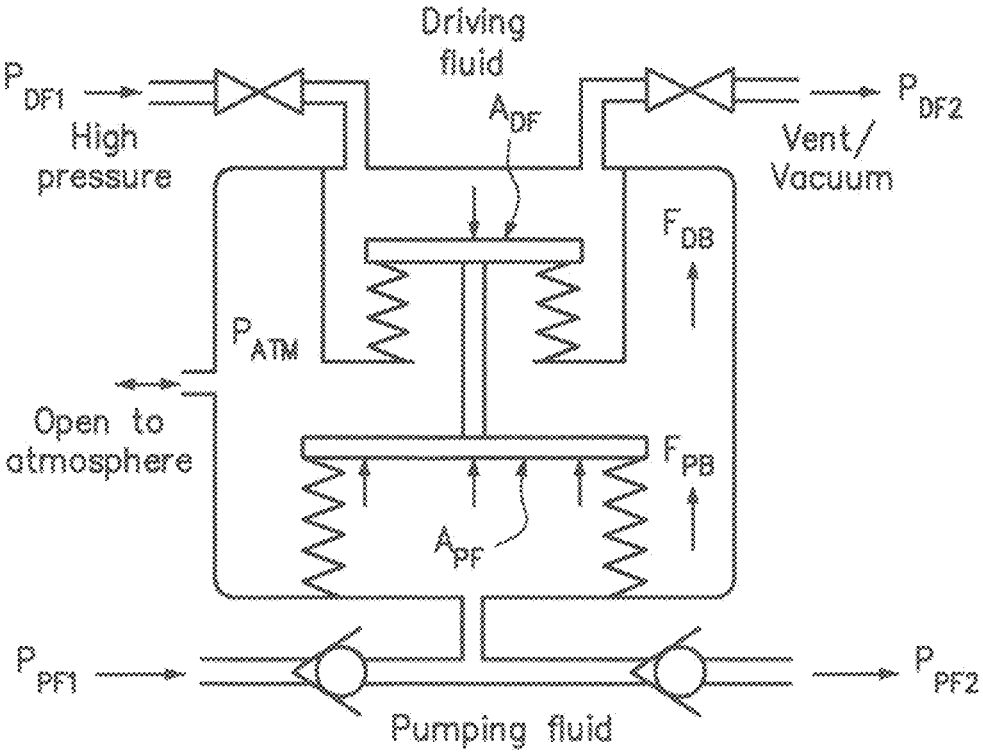
FIG. 8 is a schematic diagram of a pump assembly including driving fluid bellows and the pumping fluid bellows assisting in drawing the pumping fluid into the pump fluid chamber.

FIG. 8 is a schematic diagram of a pump assembly including a stroke volume multiplier with the atmospheric pressure assisting in pressurizing and displacing the pumping fluid from the pumping fluid chamber. The driving fluid and the pumping fluid bellows are configured to assisting in drawing the pumping fluid into the pump fluid chamber, as might be required in a vacuum pump.

Figure 9:
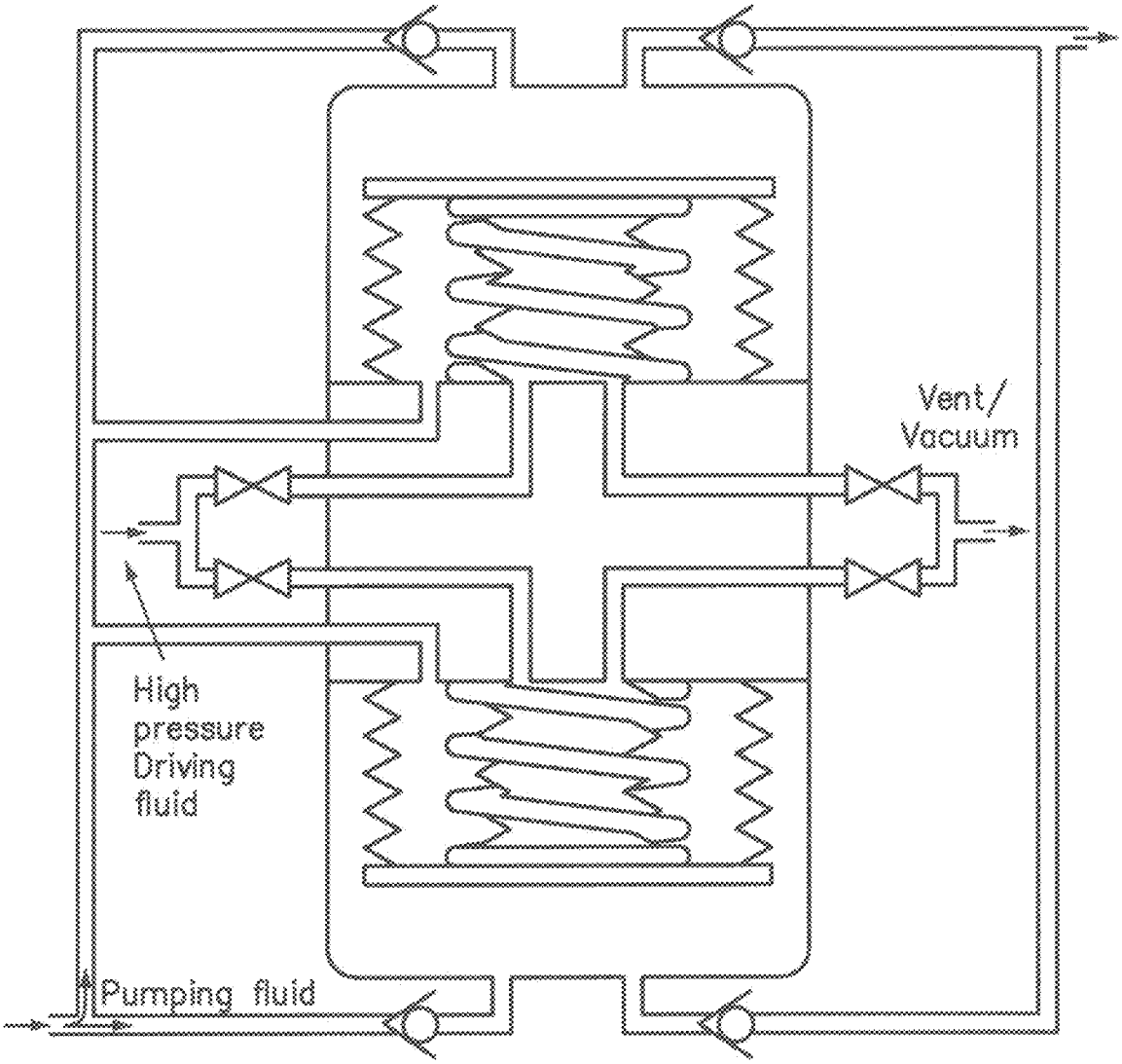
FIG. 9 is a schematic diagram of a pair of pump assemblies (each corresponding to FIG. 7) fluidically coupled to a common driving fluid actuator for alternating actuation and retraction of the driving fluid bellows with a stroke volume multiplier, wherein the driving fluid bellows, the pumping fluid bellows, a spring and the pressure of the pumping source each assisting in pressurizing and displacing the pumping fluid from the pumping fluid chamber.

FIG. 9 is a schematic diagram of a pair of pump assemblies (each corresponding to FIG. 7) fluidically coupled to a common driving fluid actuator for alternating actuation and retraction of the driving fluid bellows with a stroke volume multiplier, wherein the driving fluid bellows, the pumping fluid bellows, a spring and the pressure of the pumping source each assisting actuation of the driving fluid bellows. The forces required to operate the pump head have been described in relation to FIG. 7. It should be recognized that while the two pump heads in FIG. 9 are illustrated as being fluidically coupled with control valves, the use of an electrochemical actuator negates the need for the control valves and separate pressure and vent lines. Rather, an electrochemical stack may be disposed fluidically as in FIG. 3 or a single cell or multiple cells physically in parallel may be disposed fluidically as in FIG. 21.

Figure 10:
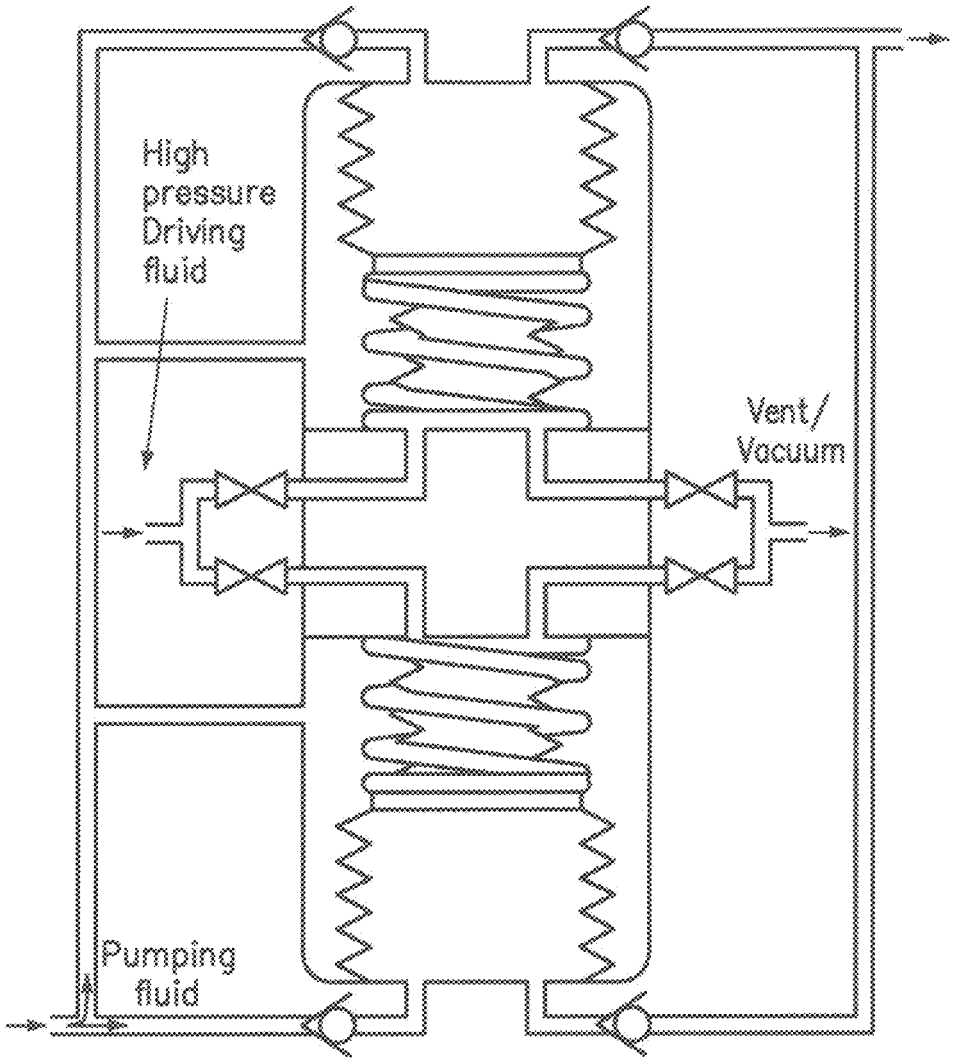
FIG. 10 is a schematic diagram of a pair of pump (each corresponding to FIG. 5D) fluidically coupled to a common driving fluid actuator for alternating actuation and retraction of the driving fluid bellows with a stroke volume multiplier and spring assistance.

FIG. 10 is a schematic diagram of a pair of pump assemblies (each corresponding to FIG. 5D) fluidically coupled to a common driving fluid actuator for alternating actuation and retraction of the driving fluid bellows with a stroke volume multiplier and spring assistance. As mention with respect to FIG. 9, an electrochemical actuator may be configured with the pump assemblies without use of the control valves and tubes.

Figure 11:
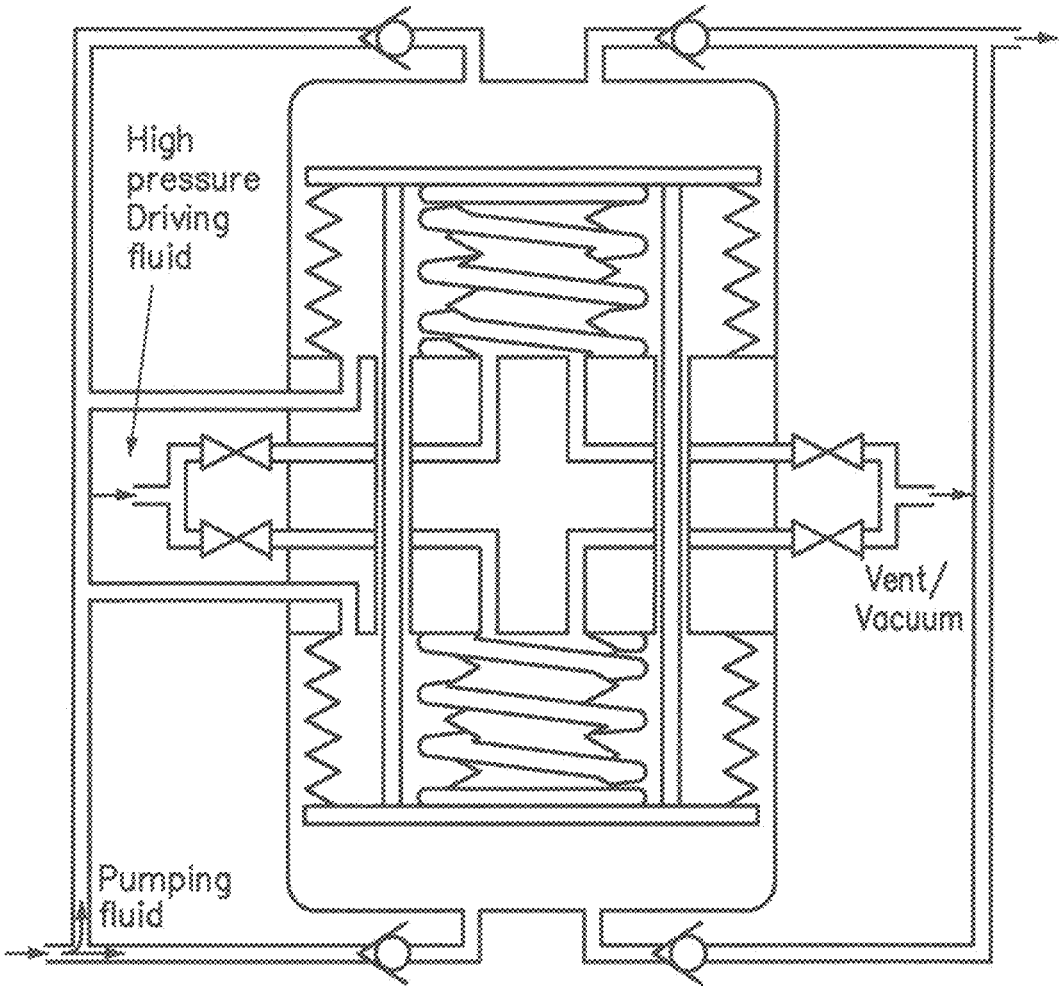
FIG. 11 is a schematic diagram of a pair of pump assemblies similar to FIG. 10, except that the spring assistance has been supplemented (or alternatives, replaced) with a mechanical coupling between the opposing stroke volume multipliers.

FIG. 11 is a schematic diagram of a pair of pump assemblies similar to FIG. 10, except that the spring assistance has been supplemented (or alternatively, replaced) with a mechanical coupling between the opposing stroke volume multipliers. Accordingly, the actuation of the two bellows pumps is mechanically linked. This arrangement may be referred to as a reciprocating dual bellows pump. Mechanically linking the actuation of a conventional dual bellows pump increases the pump efficiency. However, when used in conjunction with the stroke volume multiplier and spring, the pump is actually less efficient due to the cancelling forces of the springs.

Figure 12:
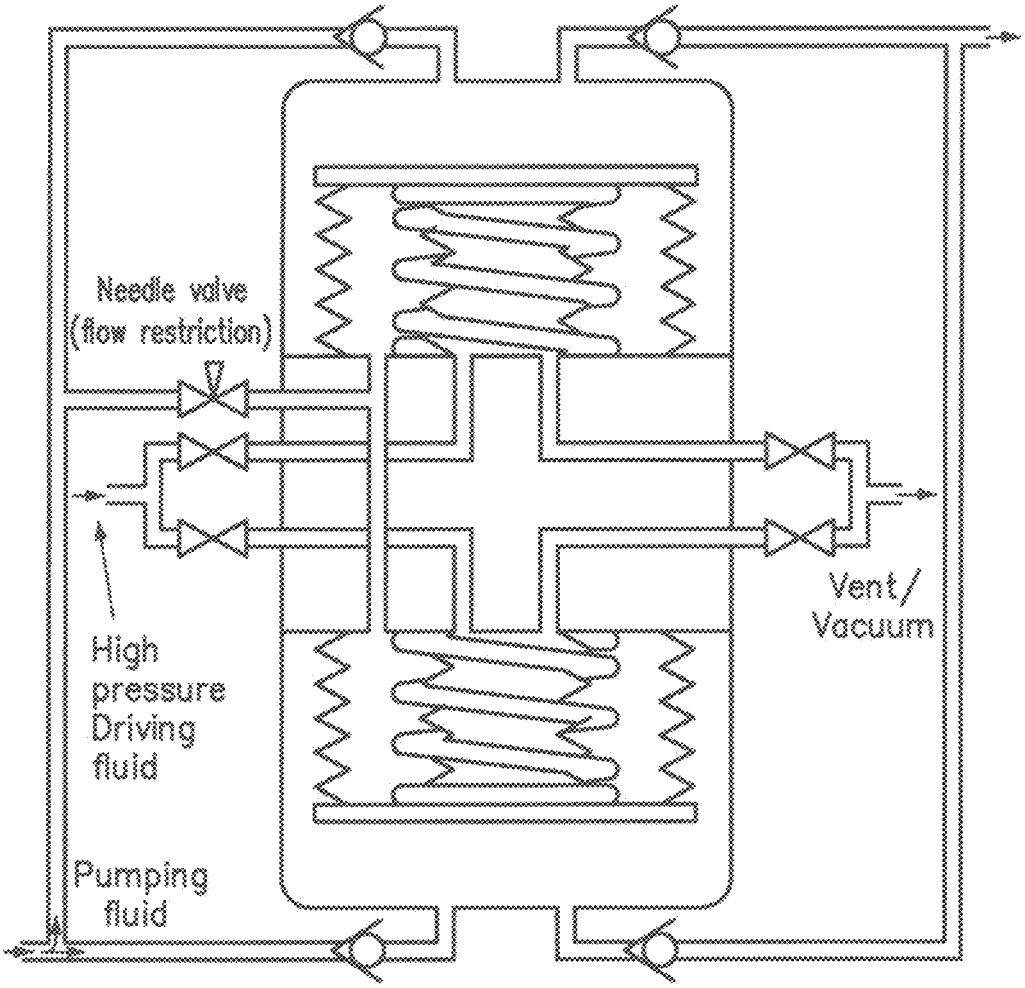
FIG. 12 is a schematic diagram of a pair of pump assemblies similar to FIG. 11, except that the mechanical coupling has been replaced with a flow restriction that affects a fluidic coupling between the opposing stroke volume multipliers.

FIG. 12 is a schematic diagram of a pair of pump assemblies similar to FIG. 11, except that the mechanical coupled has been replaced with a flow restriction that affects a fluidic coupling, rather than a mechanical coupling, between the opposing stroke volume multipliers.

FIG. 13 is a schematic diagram of a pair of pump assemblies similar to FIG. 9, except that the pumping fluid bellows has been replaces with a piston.

FIG. 14 is a schematic diagram of an electrochemical actuator in the form of an electrochemical hydrogen pump with one electrode in direct communication with a driving fluid bellows, and an electrolyzer for adjusting the amount of hydrogen gas available to the hydrogen pump. It should be recognized that a region below the electrochemical hydrogen pump may also be configured with a driving fluid bellows for use in conjunction with the pumps of FIGS. 9-13. The electrolyzer does not need to be the same size as the electrochemical hydrogen pump, and will typically be much smaller.

Due to its small molecular size, hydrogen permeates through most materials. Hermetically sealing the hydrogen within a device, such as an electrochemical actuator, for more than a few years is problematic. According to another embodiment of the invention, one solution is to create the hydrogen in the actuator when it is first needed and then replenish the hydrogen as it is lost. One method of hydrogen generation is via electrolysis of water to produce hydrogen and oxygen gas.

The amount of hydrogen in the electrochemical actuator can be determined by the time taken to drive all the hydrogen from one chamber to another. The voltage required to drive hydrogen from one chamber will be low until there is little hydrogen left to drive across the membrane electrode assemblies. When hydrogen is scarce, the voltage required to drive the same current will be much higher. If it is determined that the amount of hydrogen in the pump has diminished it can be replenished from the hydrogen source, such as an electrolyzer, that is in communication with one or multiple chambers of the pump.

Electrolysis can be performed in a separate electrolyzer or in one or more of the electrochemical cells of the electrochemical hydrogen pump. Water for electrolysis can be stored in the electrochemical membrane of the electrolyzer. Water stored in the electrochemical hydrogen pump can also be used for electrolysis since the water will diffuse between the membranes.

The oxygen gas generated by the electrolyzer must be removed to prevent it from recombining with the hydrogen gas. One option is to vent the gas through a check valve, as shown in FIG. 14, but this option is not ideal for long life pumps since the water contained in the electrochemical hydrogen pump and electrolyzer will eventually be lost. Since check valves do not seal perfectly, water vapor will escape through the check valve during storage. During operation, water vapor will be lost as the oxygen is purged.

Figure 15:
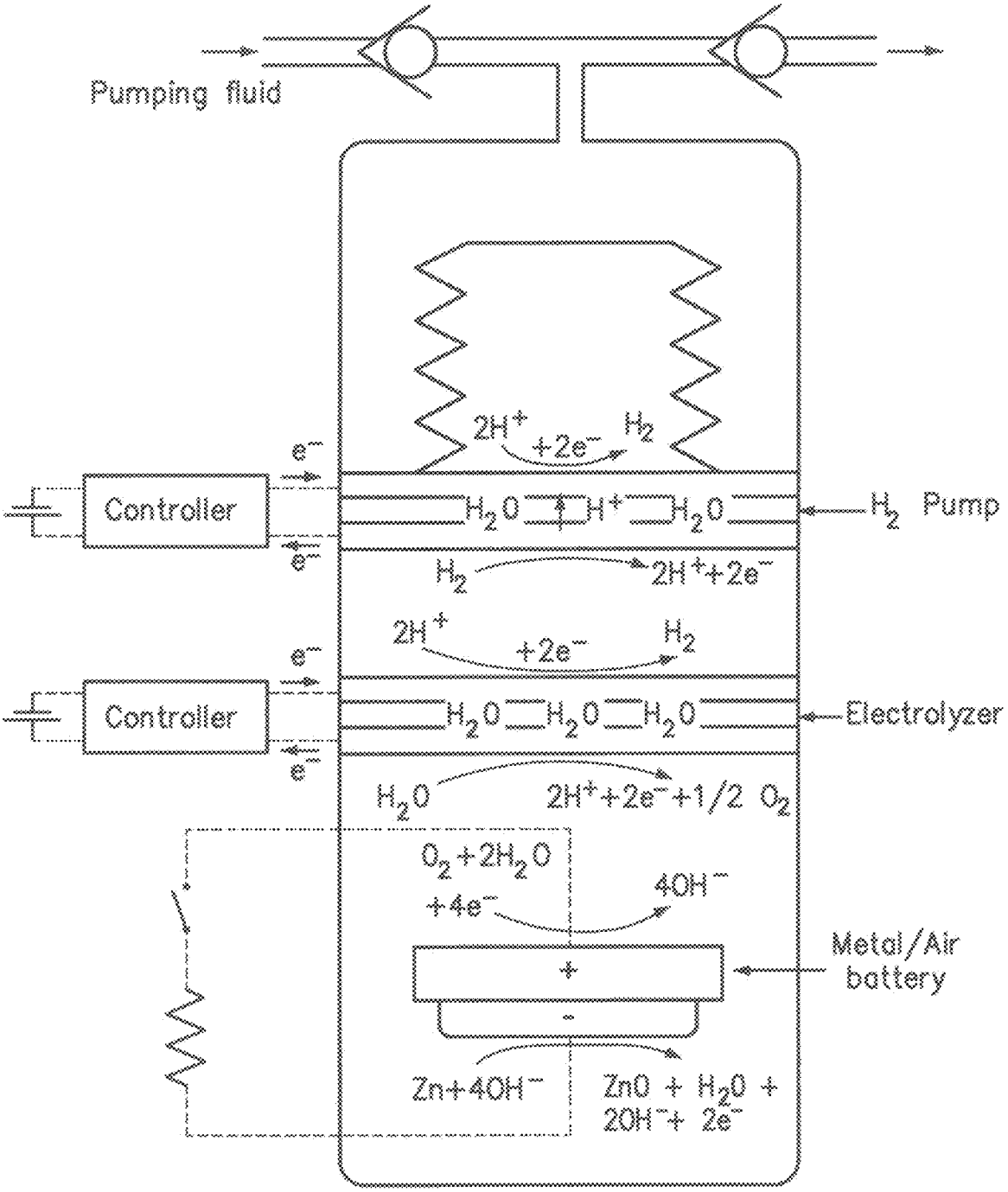
FIG. 15 is a schematic diagram of an electrochemical actuator in the form of an electrochemical hydrogen pump with one electrode in direct communication with a driving fluid bellows, an electrolyzer for adjusting the amount of hydrogen gas available to the electrochemical hydrogen pump, and a metal/air battery for consuming oxygen from the electrolyzer.

FIG. 15 is a schematic diagram of an electrochemical actuator in the form of an electrochemical hydrogen pump with one electrode in direct communication with a driving fluid bellows, an electrolyzer for adjusting the amount of hydrogen gas available to the electrochemical hydrogen pump, and a metal/air battery for consuming oxygen from the electrolyzer. A second method of removing the oxygen gas is to consume it in a metal/air battery, for example Zn/air, Li/Air, Fe/air etc, as shown in FIG. 15. By placing a load across the battery when oxygen gas is present, current will be drawn from the battery and the oxygen gas will be consumed.

Figure 16:
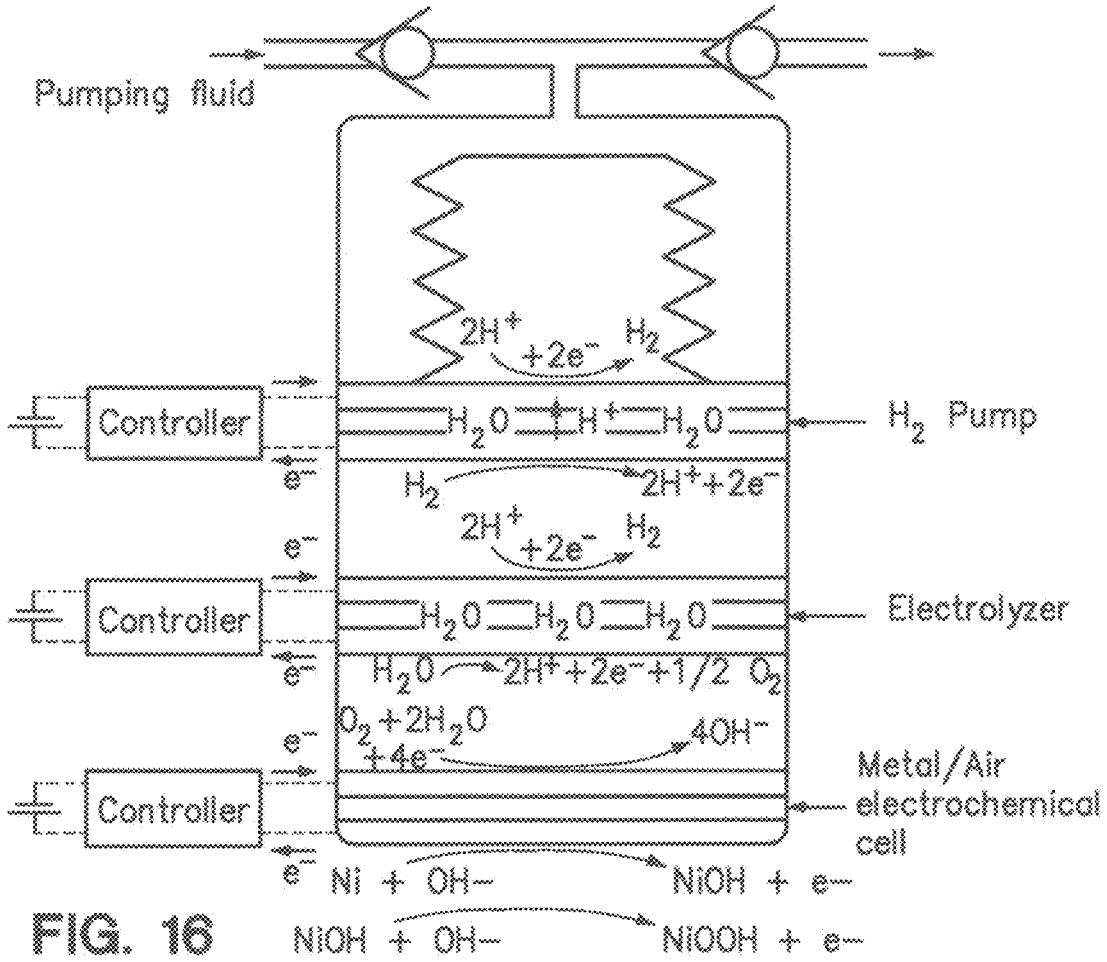
FIG. 16 is a schematic diagram of an electrochemical actuator in the form of an electrochemical hydrogen pump with one electrode in direct communication with a driving fluid bellows, an electrolyzer for adjusting the amount of hydrogen gas available to the electrochemical hydrogen pump, and a metal/air electrochemical cell for consuming oxygen from the electrolyzer.

FIG. 16 is a schematic diagram of an electrochemical actuator in the form of a electrochemical hydrogen pump with one electrode in direct communication with a driving fluid bellows, an electrolyzer for adjusting the amount of hydrogen gas available to the electrochemical hydrogen pump, and a metal/air electrochemical cell for consuming oxygen from the electrolyzer. A third method of removing the oxygen gas is to consume it in a metal/oxygen electrochemical cell, for example Ni/air, as shown in FIG. 16. This has the benefit that the total potential of the metal/air cell is too high for spontaneous hydrogen evolution. The nickel oxidation reaction is driven by applying a potential across the cell when oxygen gas is present. In some situations pump performance can be improved by reducing hydrogen pressure to an optimal level. This can be achieved by charging the metal/air battery or reversing the metal/oxygen electrochemical cell to generate oxygen gas. The oxygen will react with the hydrogen to form water.

According to another embodiment of the invention, any hydrogen lost is replenished with hydrogen stored within a metal hydride alloy material. The hydrogen can be extracted from the metal hydride through either gas phase or electrochemical means. This method also allows the hydrogen pressure within the device to be controllably increased or decreased by releasing or storing hydrogen within a metal hydride alloy.

Figure 17:
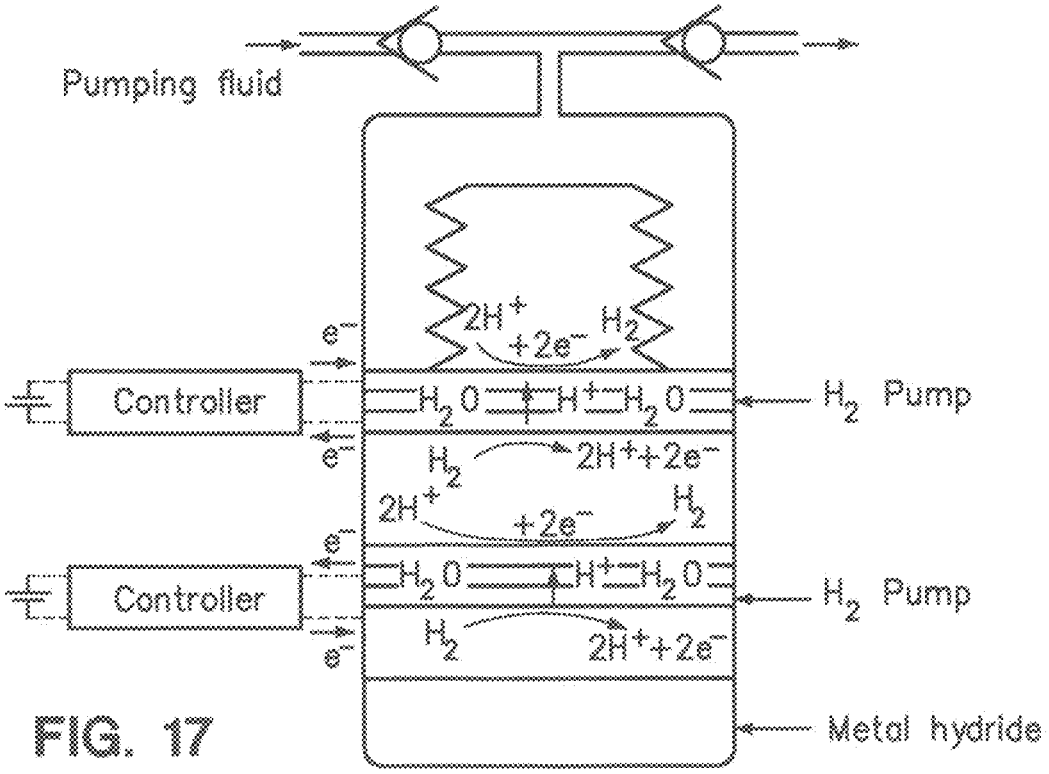
FIG. 17 is a schematic diagram of a pump assembly including metal hydride during operation to release hydrogen.

FIG. 17 is a schematic diagram of a pump assembly including metal hydride for the release of hydrogen. An electrochemical hydrogen pump can be used to move hydrogen gas from a chamber in which the metal hydride is stored and into the electrochemical actuator, thereby increasing the hydrogen pressure within the electrochemical actuator. The low hydrogen pressure created around the metal hydride alloy will result in the release of hydrogen from the metal hydride. The hydrogen pressure within the electrochemical actuator can be decreased by using an electrochemical hydrogen pump to move hydrogen from the actuator into a chamber in which the metal hydride alloy is stored. The increased hydrogen gas pressure about the hydride will result in hydrogen being absorbed by the metal hydride alloy.

Figure 18:
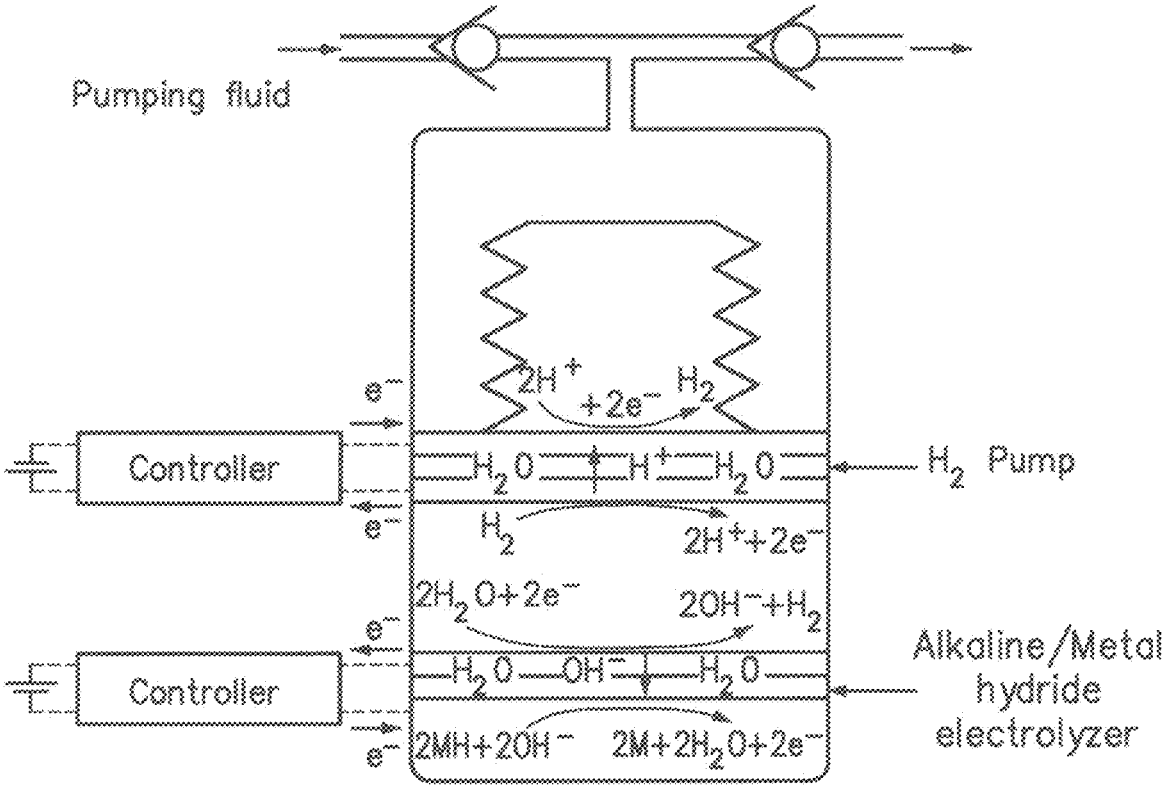
FIG. 18 is a schematic diagram of a pump assembly including an alkaline metal hydride electrolyzer during operation to release hydrogen.

FIG. 18 is a schematic diagram a pump assembly including an alkaline metal hydride electrolyzer during operation to release hydrogen. Electrochemical release of hydrogen from the metal hydride can be achieved using the alkaline electrolyzer. Water is electrolyzed at the cathode to form hydrogen gas and OH ions. At the anode, the OH ions combine with hydrogen from the metal hydride to form water. This system has the benefit that it does not generate any oxygen so does not require the added complexity of an oxygen absorption system.

Figure 19:
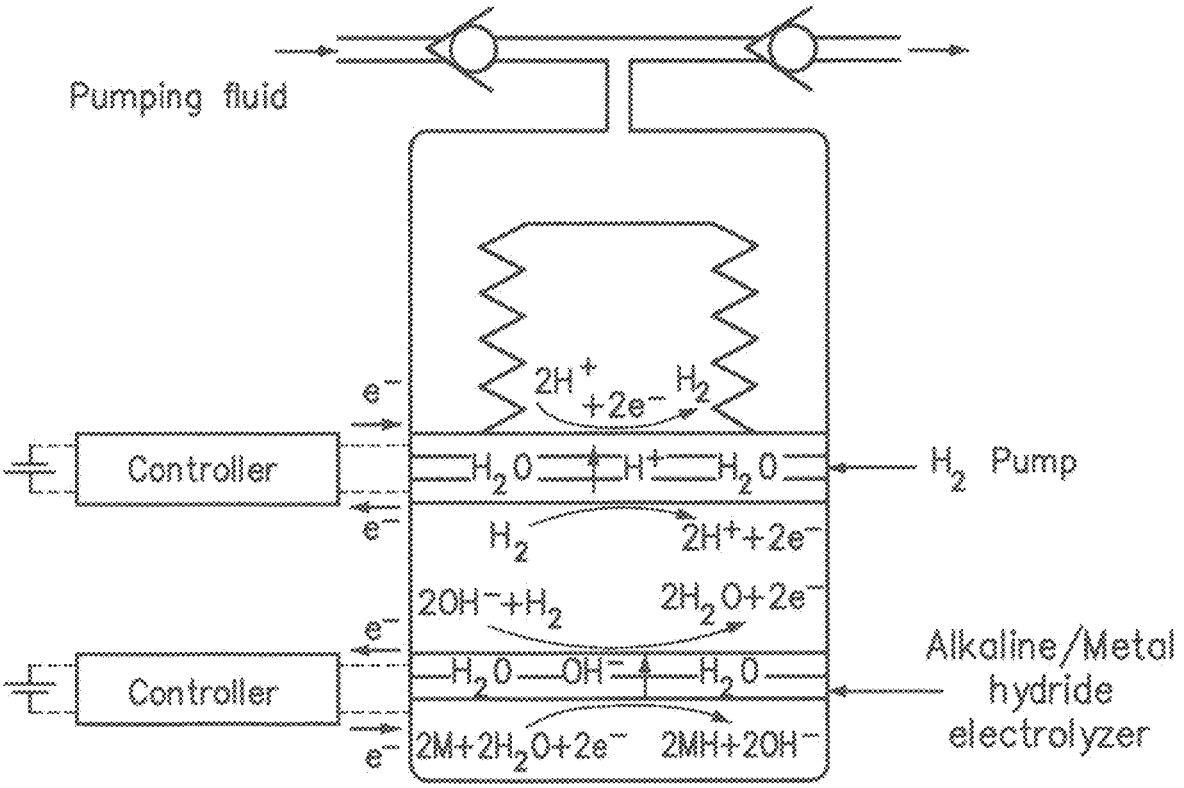
FIG. 19 is a schematic diagram of a pump assembly in FIG. 17 during operation to store hydrogen.

FIG. 19 is a schematic diagram of the pump assembly in FIG. 18 during operation to store hydrogen. Electrochemical storage of hydrogen is achieved by electrolyzing water at the metal hydride alloy, which acts as a catalyst to form OFF. The $H^+$ ions formed in the reaction attach to the metal hydride alloy. At the anode the OH ions combine with hydrogen gas to form water.

Figure 20A:
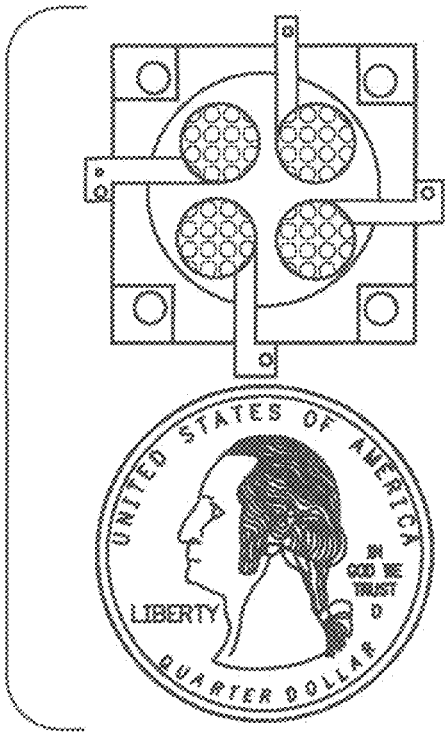
FIG. 20A is a plan view of a four cell current collector made from titanium with an applied protective coating.

FIG. 20A is a plan view of a four cell current collector. To prevent corrosion of the current collector, electrochemically stable materials such as graphite, gold, inconel, Ti—Ni alloys are used. Other materials, which are not as stable, such as stainless steel, stainless steel, titanium, or niobium, can be used if protected by a conductive, electrochemically stable coating. The current collector shown is adhesively bonded to a fiberglass board and the electrode pattern machined out. This arrangement of multiple cells connected electronically in series is useful to address the very low power requirements of the electrochemical hydrogen pump. Since there are no commercially available DC/DC converters which can efficiently transform conventional battery voltages (1.2 to 3.0 V) down to the required pump voltage (<150 mV). A partial solution to this problem is the use of multiple pump cells connected electrically in series. The voltage that must be applied to the pump then becomes the sum of the voltage drop across each cell. This solution can become problematic if too great a number of cells are required. If a large number of cells are required, then the size of the individual cells can be too small making manufacturing and assembly difficult. However, this approach can be used to boost the driving voltage of the pump to a level where a DC/DC converter can operate more efficiently.

Figure 20B:
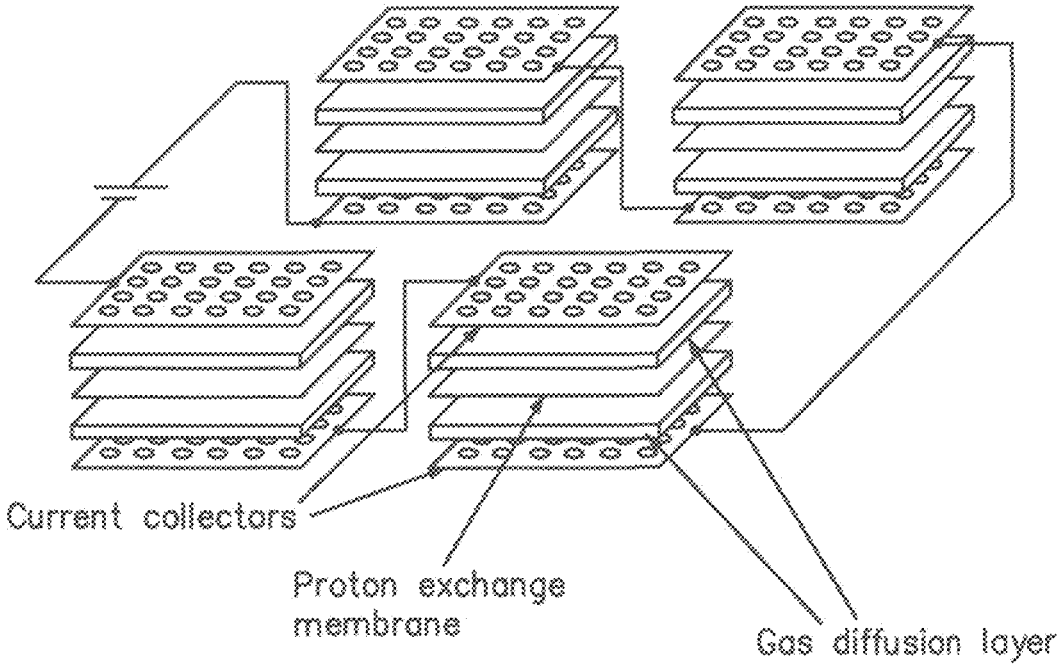
FIG. 20B is a schematic perspective view of the multiple cells of FIG. 20A.

FIG. 20B is a schematic perspective view of the multiple cells of FIG. 16A. With the multiple cells electrically connected in series, the voltage that must be applied to the pump is the sum of the voltages applied across each cell. The multiple electrochemical hydrogen pumps shown can share the same current collector support material, pump housing and proton conducting membrane.

Figure 21:
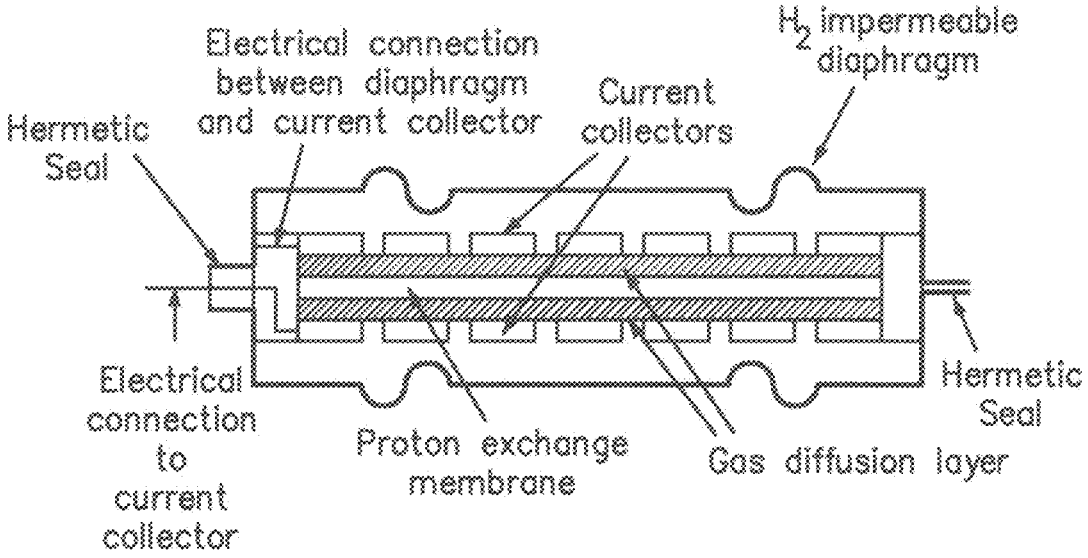
FIG. 21 is a schematic diagram of an electrochemical actuator that is hermetically sealed.

FIG. 21 is a schematic diagram of an electrochemical actuator that is hermetically sealed within a material, such as aluminum, that has a very low permeability to hydrogen. All components of the pump that come into contact with hydrogen, such as the current collectors, gas diffusion layers, and membranes, are within the hermetically sealed environment. Within this sealed environment, the rate of loss of hydrogen gas is extremely low and the humidity remains constant. The material used to hermetically seal the pump can also be used to form the diaphragm. Stretching or forming the material across the chambers of the pump can do this, for example. Two electrical connections must be made to the electrochemical actuator to drive the necessary ion current through the membrane electrode assembly. One of the electrical connections can be made directly through the sealing material if it is electrically conductive.

At very low pumping rates the multi-cell electrochemical hydrogen pumps still may not boost the driving voltage to a level where a conventional DC/DC converter circuits can operate efficiently unless a large number of cells are used, in which case manufacturing would be exceedingly difficult. One option is to take advantage of the fact that, unlike most electronic components, the electrochemical hydrogen pump does not need a "clean" or uniform voltage to operate. The flow rate is determined only by the average electrochemical hydrogen pump current. The only concern is if the root mean square (RMS) of the applied voltage is significantly greater than the average voltage, in which case the power drawn by the electrochemical hydrogen pump will be significantly greater than if the voltage were uniform. A conventional DC/DC converter can be used to efficiently convert a battery voltage down to 0.6 V (the lowest voltage that can efficiently be obtained with commercially available DC/DC converters), and then pulse width modulation (PWM) may be used to provide smaller average voltages to the electrochemical actuator. The duty cycle, that is the ratio of time the voltage is off to the time the voltage is on, determines the average value of the voltage across the electrochemical actuator.

Figure 22:
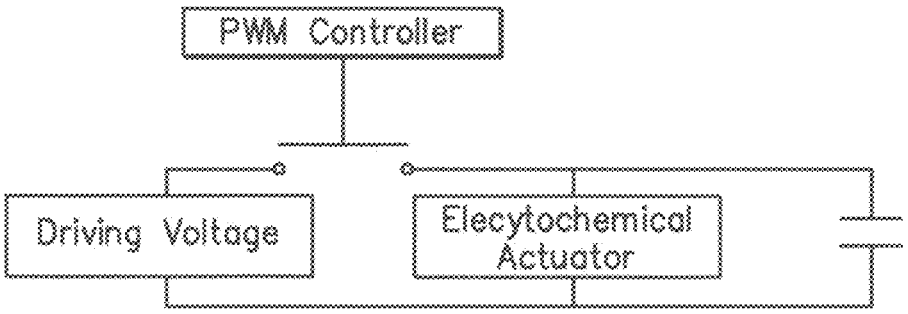
FIG. 22 is a block diagram of the pulse width modulation control of the electrochemical actuator voltage.
Figure 23:
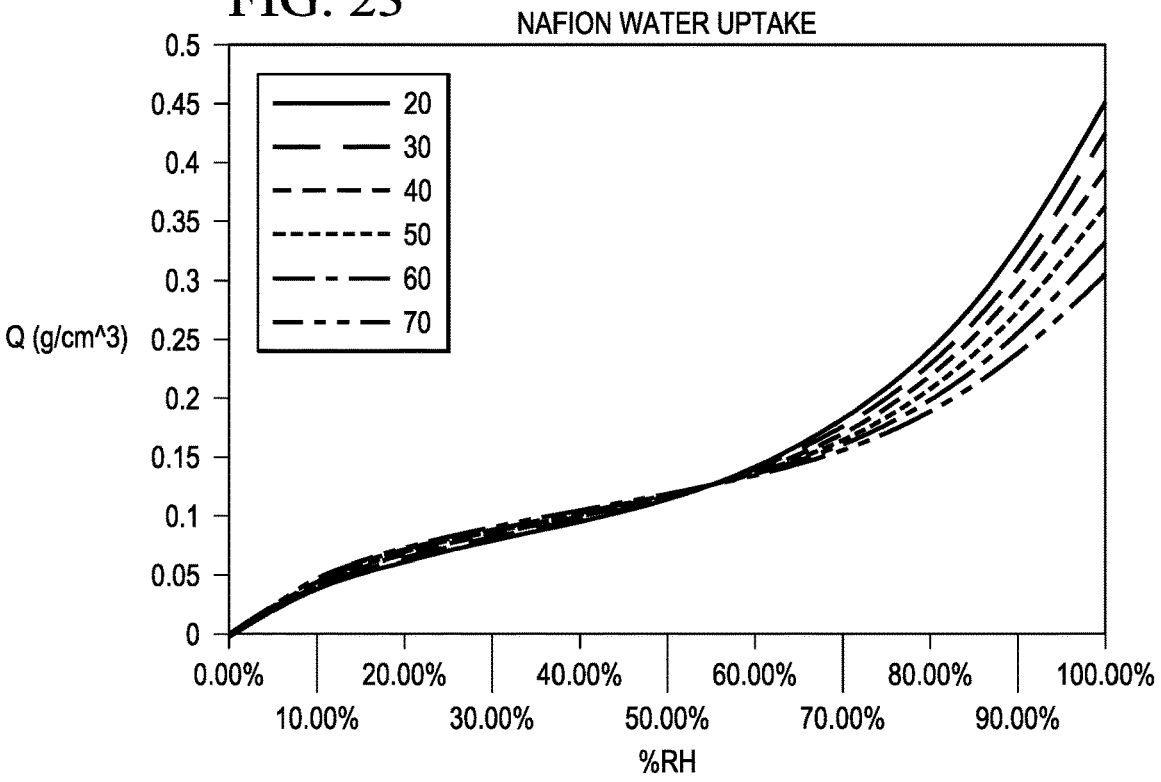
FIG. 23 is a graph that shows changes in water uptake with temperature for a Nafion ion exchange membrane.

FIG. 22 is a block diagram of the PWM voltage control. The output of the DC/DC converter is fed to a low resistance electrical switch (such as a metal-oxide-semiconductor field-effect transistor or "MOSFET") that is controlled by a microcontroller. The microcontroller rapidly turns the MOSFET on and off, and so turn the voltage across electrochemical hydrogen pump on and off. The efficiency of the circuit depends only on the switch resistance and the RMS value of the voltage applied to the electrochemical hydrogen pump.

The efficiency of the PWM voltage control can be increased by placing a capacitor in parallel with the electrochemical hydrogen pump. This has the effect of reducing the RMS value of the applied voltage.

A 4-cell pump having 3 $cm^2$ of active area may produce a load of about 1Ω. At a current of 100 mA, equivalent to a flow rate of 500 mL/hr, will consume only 30 mW. At currents below 50 mA, equivalent to a flow rate of 250 mL/hr, the efficiency starts to become poor; however, at these flow rates the power requirements of the pump are minimal.

Due to its small molecular size, hydrogen permeates through most materials. Hermetically sealing the hydrogen within a device, such as an electrochemical actuator, for more than a few years is problematic. The loss of hydrogen from the device after a few years is inevitable. According to another embodiment of the invention, any hydrogen lost is replenished with hydrogen stored within a metal hydride alloy material. The hydrogen can be extracted from the metal hydride through either gas phase or electrochemical means. This method also allows the hydrogen pressure within the device to be controllably increased or decreased by releasing or storing hydrogen within a metal hydride alloy.

In a still further embodiment of the invention, damage to the electrochemical hydrogen pump due to ice formation in the catalyst layer and GDL can be prevented by reducing the humidification in the electrochemical stack to less than 100% relative humidity. In the sealed environment of the stack, as the temperature of the stack is reduced, the water absorption capacity of the electrochemical membrane (typically Nafion) increases. This results in the relative humidity staying below 100% and prevents condensation of liquid water.

Still further, electrochemical cells are typically operated with a well-humidified membrane in order to reduce the electrical loses. This poses a problem for electrochemical hydrogen pumps at high temperatures due the high water pressure in the sealed environment of the pump where the water vapor pressure can become a significant fraction of the hydrogen pressure. A large water vapor pressure will limit the compression of the driving fluid bellows and reduce the efficiency of the pump. By operating the pump with relatively dry membranes, the water vapor pressure is reduced (low relative humidity) and the reduction in pump stroke at high temperatures is minimized. When operating at high temperatures and low relative humidity, the membranes can dry out due to electro-osmotic drag, resulting in an increase in cell resistance. This effect can be reduced by incorporating hydroscopic metal oxide (e.g. $ZrO_2$, $TiO_2$, $SiO_2$, $WO_3$, and zeolite) particles in the membrane.

As will be appreciated by one skilled in the art, the controller used in various embodiments of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the operation of the controller may take the form of a computer program product embodied in any tangible medium of expression having computer-usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the method.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the method.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the method discussed above.

It should be recognized that many, if not all, of the pump designs disclosed above, in the context of being driven by an electrochemical actuator, may also be driven by other means. For example, the pump designs may be driven by gases pressurized by mechanical means or driven by mechanical linkage to mechanical or electromechanical devices. One non-limiting example is an electrical motor rotating a cam shaft that engages a cam follower having a distal end that reciprocates to expand and/or contract the bellows or a corresponding piston.

Water Management by Membrane volume:enclosed volume ratios.

The pumps are designed wherein a polymeric ion conducting membrane is adjacent to an enclosed volume. The enclosed volume is defined as the volume enclosed by the anode and cathode driving fluid chambers, the anode and cathode porous electrically conducting electrodes and connecting flow paths. The enclosed volume typically contains the driving fluid, hydrogen. It is important to note that the enclosed volume is mostly sealed to the outside, with no way of introducing additional humidity from a source external to the pump.

A problem occurs if the humidity within the enclosed volume is too low. The performance of the electrochemical pump is partly a function of the conductivity value of the polymer ion exchange membrane. Nafion is an example of an ion exchange membrane. Other examples of ionically conducting membranes include proton conducting perfluorosulfonic acid membranes (such as Aciplex membranes, Asahi Glass Flemion membranes, 3M membranes, etc.), proton conducting hydrocarbon membranes (such as Ube Plastic membranes, Polyfuel membranes, etc.), sulfonated polymeric membranes that conduct protons, mechanically reinforced membranes (such as Gore membranes, etc.), unreinforced proton conducting membranes, etc., but not limited to these. The ionic conductivity value of a Nafion (or any other proton conducting polymeric membranes that needs hydration) membrane is a strong function of its water content. Studies have shown a strong relation between the relative humidity of the membrane's environment and the membrane's ionic conductivity. The point is that as ionic conductivity decreases, electrical resistance of the membrane increases, thereby increasing electrical energy needed to drive the pump. Another way of saying that is that for a given electrical current flow between the electrodes, the voltage drop increases as the membrane's water content decreases. Therefore, it is preferable to keep the membrane in a suitably high conductivity state, by maintaining appropriate levels of humidity in the enclosed volume that is in fluidic contact with the membrane, to maintain good pumping efficiency.

Problems can also occur if humidity is too high. It is noteworthy that the electrodes used a gas diffusion medium, composed of a porous network. The porous network allows rapid diffusion of reactant gases (hydrogen) and facilitates electron transfer reactions that occur at the interface between the conducting electrode and the ionic conduction by the membrane. Elevated humidity in the enclosed volume may result in condensation as liquid water within the porous gas diffusion network, posing a significant risk to the pump as is can plug hydrogen passages and potentially flood the porous electrode with liquid water preventing hydrogen from diffusing to the active catalyst sites, resulting in efficiency loss and a potentially unrecoverable condition. Therefore it is critical to maintain sufficient humidity for membrane conductivity while avoiding the risk of condensing liquid water. The situation is complicated by water passage through the membrane during operation of the pump, carried by electroosmosis. The rate of water transport is a function of the current being passed.

Figure 24:
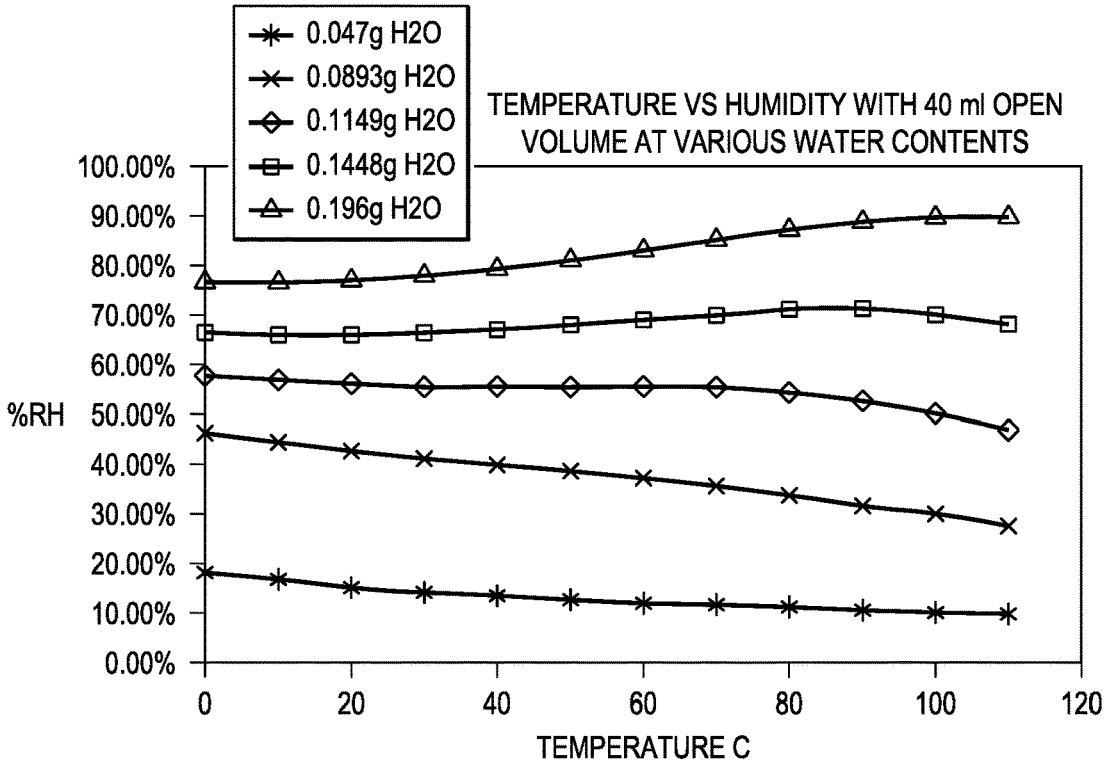
FIG. 24 is a graph that shows temperature versus humidity.

FIG. 22 is a graph that shows changes in water content with temperature for a Nafion ion exchange membrane. The total amount of water absorbed by the Nafion is a function of both temperature and relative humidity, with the total water uptake declining with temperature. Consideration of this feature is important when designing a closed, humidified system with Nafion. As in FIG. 24 is a graph that shows that a given volume of Nafion membrane (~1 mL) is placed into a electrochemical hydrogen pump cell, where the enclosed volumes (cathode and anode driving fluid chambers, porous electrodes and associated flow paths have a volume of ~30 mL (i.e., 30:1 volume ratio), the equilibrium of water both in the membrane and adjacent space volume as water vapor may be tracked. As the temperature rises, Nafion will release some of its water, which will enter the enclosed volume as water vapor. However, as the temperature increases, the saturation pressure of the water vapor also increases. To determine the net change in relative humidity the competing functions must be solved.

Figure 25:
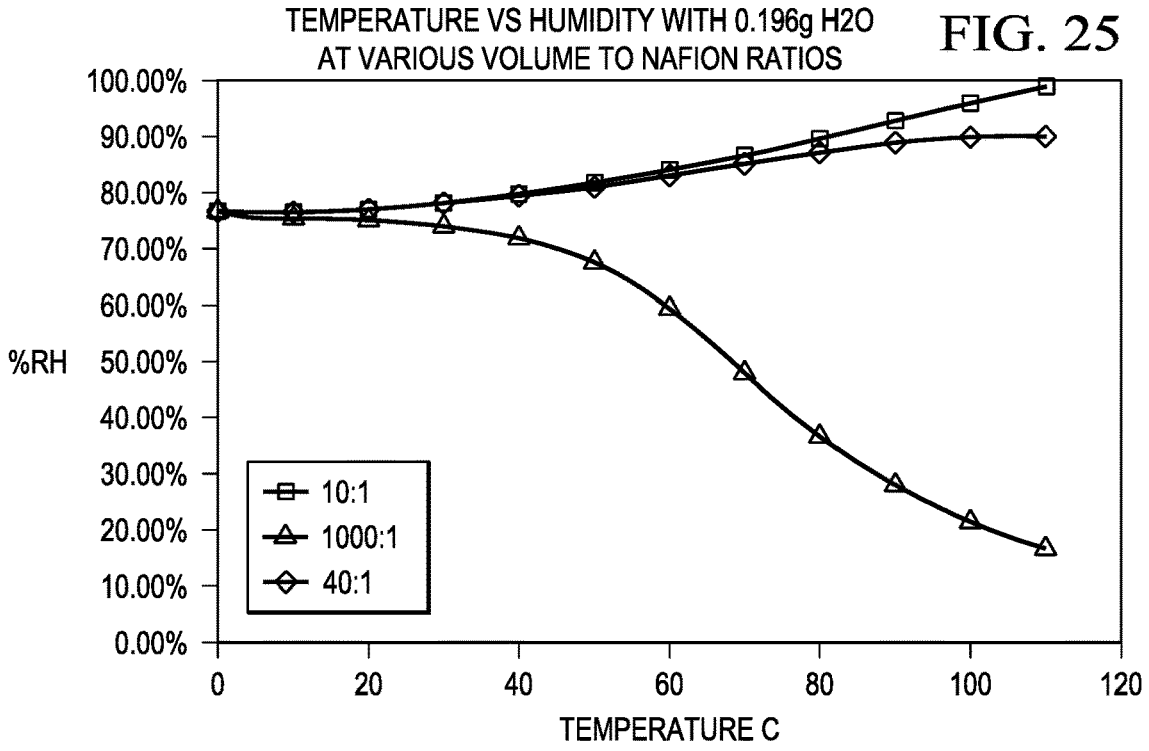
FIG. 25 is a graph that shows the effects of dynamic water balance.

As can be seen in FIG. 25, there are specific Nafion volume to enclosed volume ratios that would yield a favorable, near constant relative humidity (+/−10% RH) throughout a rather large temperature range. However, if two alternate ratios are examined, different results are observed with increased sensitivity to temperature changes. At a 100:1 volume ratio, the system relative humidity drops off sharply above 40° C. This would cause significant performance issues if the pump was operated at these conditions. At a volume ratio of 2:1, the relative humidity approaches saturation, more so at elevated temperatures, which would cause unwanted condensation within the porous electrode structure and the connected flow paths.

It is therefore preferable to have a ratio of membrane volume to enclosed volume within a desirable range, as indicated by Table 1. The Table gives the preferred volume ratios needed for the invention. The following definitions help understand this invention, since volume enclosed by the driving pump chamber, flow fluid flow path and porous electrodes varies with pump/stroke operation.

Prime Volume: Internal hydrogen chamber volume of one half of the pump (including dead volume) when the diaphragm is fully retracted (minimum pump volume)—AKA Ullage Displacement volume: Internal volume of one hydrogen diaphragm displacement (difference between fully extended and fully retracted)

Pump Volume: Internal hydrogen chamber volume of one half of the pump (including dead volume) when the diaphragm is fully extended (maximum pump volume) [one prime volume plus one displacement volume]

Average Volume: Average internal hydrogen chamber volume during normal operation [(2× prime volume)+one displacement volume]−total volume when one diaphragm is extended and the other is retracted Nafion Volume: The total volume of Nafion membrane inside the pump (including active area and non-active area).

Certain preferred ratios are as follows

- Prime volume: Nafion volume ratio is between 3.9 and 9.0.
- Displacement volume: Nafion volume ratio is between 4.0 and 16.0
- Pump volume: Nafion volume ratio is between 8.0 and 22.0
- Average volume: Nafion volume ratio is between 12.0 and 28.0

Pump 1. An electrochemical medical pump was designed for drug infusion applications. The pump was intended to deliver intravenous medication at flow rates up to 500 ml/hr. The key advantages of the medical pump are small size (~1 in), low power for long battery life (<50 mW) and accurate drug delivery. As designed the pump included a stroke volume multiplier (SVM) with a medical grade silicone fluid diaphragm, metalized Mylar hydrogen diaphragm, tapered compression spring bias, and integrated capacitive piston position sensor. Electrochemically the pump was a planer 4 cell design with ~4 $cm^2$ of total active area. In this unique disposable application, hydrogen was generated on demand with an internal electrolyzer. The oxygen produced was vented through a uni-directional check valve to prevent recombination and extend the shelf life. After assembly and testing the pump performed as expected with aqueous solutions.

Pump 2. An electrochemical coolant pump was designed for spacecraft electronics thermal control. The pump operated at a system pressure of 350 kPa to avoid cavitation as the coolant was water at 100 C. The application required a flow rate of 750 ml/min and a pressure rise of 28 kPa. The pump was designed for low frequency operation, which reduced the fluid velocities in the pump head, thus limiting the minimum localized pressures, which cause cavitation. Ultimately the unique design enabled the high system pressure to be reduced, easing many of the coolant loop design requirements and saving mass. As designed, the pump included a SVM with two concentric edge welded metal bellows in a donut configuration creating three closed fluidic chambers. Each of these chambers served a specific purpose. The inner chamber was used for the hydrogen displacement, the outer chamber was used for the coolant displacement and the intermediate chamber was used as a pressure compensation device for efficient operation the electrochemical pump at high system pressures. This was accomplished by porting the pump inlet coolant fluid to the intermediate chamber and with the assistance of a custom compression spring bias design. The selection of the metal bellows was driven primarily by the long life requirements of the application. This mechanical configuration, with the absence of rotating machinery and wear items, could theoretically last indefinitely. In addition the metal bellows allowed a completely metal hermetic design, which is projected to prevent the hydrogen gas from escaping for decades. Piston position was accomplished via an inductive sensor integrated into the pump head. Electrochemically, the pump utilized a bi-planar stack of 41 cells for a total of 1450 $cm^2$. Due to the hermetic, long life design, hydrogen was stored on board via a palladium metal hydride. The quantity of hydrogen was controlled by isolating the palladium metal hydride via a secondary hydrogen pump, enabling the metal hydride to be charged and discharged as needed. Due to the specific design, nitrogen could not be allowed in the pump. Therefore the pumps were assembled in a humidified hydrogen environment. The pump clamshells are planned to be E-beam welded together after assembly to provide the continuous metal hermetic seal. Pump operation was verified with testing at the operational pressure and temperature.

Pump 3. An electrochemical water purification pump was designed for use in combination with a micropore purification filter to produce on demand drinking water. The pump was designed to provide 125 ml/min of clean water with only 0.5 W of power, enabling portable battery operation. The filter selected required 10 kPa of pressure to achieve this flow rate. As designed, the pump was a single diaphragm design to reduce the overall size. A custom, deep drawn, metalized Mylar diaphragm was used for this application with a compression spring bias. Piston extension was detected with a simple electrical contact while piston retraction was determined by the electrochemical stack voltage. Other unique features included special valves to reverse the flow and back flush the filter periodically to extend the filter life and reduce the pressure requirement. Electrochemically, the pump was a 60 cell design with a total active area of 550 $cm^2$. Hydrogen was generated on demand with an internal electrolyzer. The oxygen produced was vented through a uni-directional check valve to prevent recombination. With the application as a water purification pump, water was ported to the electrolyzer via a gore membrane to promote humidification of the pump. The pump was tested with a 0.02 micron absolute filter and ran continuously filtering 135 Liters of dirty water with automated back flushing.

Pump 4. An electrochemical coolant pump was designed for spacesuit life support thermal control. The pump was required to deliver 1.5 lpm at a pressure rise of 35 kPa. However, the system pressure was sub-atmospheric at only 27 kPa. With the coolant as water at 40° C., many rotodynamic pumps have difficulty with cavitation under these conditions due to large negative pressure peaks at the pump inlet. However, the low frequency (~0.5 Hz), positive displacement electrochemical pump shown herein reduces the minimum pressure avoiding cavitation at these conditions. Due to the low operational pressures, a single edge welded metal bellows design was implemented efficiently without a spring bias. Piston displacement was determined via an inductive sensor integrated into the pump head. Electrochemically, a 40 cell stack with a total active area of 622 cm^2 was designed and built. Due to the hermetic, long life design, hydrogen was stored on board via a palladium metal hydride. The quantity of hydrogen was controlled by isolating the palladium metal hydride via a secondary hydrogen pump, enabling the metal hydride to be charged and discharged as needed. Due to the specific design, nitrogen could not be allowed in the pump. Therefore the pumps were assembled in a humidified hydrogen environment. The pump clamshells are planned to be E-beam welded together after assembly to provide the continuous metal hermetic seal. Pump operation was verified with testing at the operational pressure and temperature.

Pump 5. An electrochemical pump was designed for active heat pipes (AHP) and loop heat pipe (LHP) systems. Typically heap pipes are passive, two phase heat transfer devices commonly used in laptops and satellites where concentrated heat fluxes need to be distributed to large radiators for effective heat rejection. However, passive heat pipes are limited in the distances and quantity of heat, which may be transferred as the liquid coolant return is based on capillary forces of fluidic wicks. Therefore an electrochemical pump was integrated into a heat pipe as a low power method of returning the liquid coolant to the heat source, greatly increasing the capacity, stability and working distance of the heat pipe. For this application a flow rate of 10 ml/min at a pressure rise of 71 kPa was required. A single, custom convoluted metal diaphragm was designed for this application due to the small displacement required. The metal diaphragm also enabled the continuous hermetic sealing of the pump once assembled. Diaphragm position was measured indirectly via current integration and pump timing. Electrochemically a 10 cell stack with a total active area of 32 $cm^2$ was designed and built. The pumps were assembled in a humidified hydrogen environment and sealed with the appropriate amount of hydrogen. No hydrogen control device was implemented.

TABLE 1

Water Management by Volume Ratios

| Pump | Approx Flow rate (mL/min) | Pressure rise | Nafion (mL) | Prime (mL) | Disp (mL) | Pump (mL) | Ave. (mL) | Prime: Nafion | Disp: Nafion | Pump: Nafion | Ave: Nafion |
|---|---|---|---|---|---|---|---|---|---|---|---|
| 1 | 8 | 7 | 0.010 | 0.091 | 0.102 | 0.193 | 0.285 | 8.996 | 10.039 | 19.035 | 28.031 |
| 2 | 760 | 28 | 3.688 | 23.000 | 32.000 | 55.000 | 78.000 | 6.236 | 8.677 | 14.913 | 21.149 |
| 3 | 125 | 25 | 1.161 | 4.600 | 4.800 | 9.400 | 14.000 | 3.963 | 4.135 | 8.098 | 12.061 |
| 4 | 1500 | 35 | 1.580 | 9.600 | 25.000 | 34.600 | 44.200 | 6.076 | 15.824 | 21.900 | 27.977 |
| 5 | 10 | 71 | 0.065 | 0.520 | 0.275 | 0.795 | 1.315 | 7.997 | 4.229 | 12.226 | 20.223 |

Hydrogen internal to the cell using metal organic framework sorbents (MOFS).

Metals and metal alloys are one way to store a large volume of hydrogen in a small volume. Another way to store a large volume of gas in a small volume of solid is to use a metal organic framework (MOF) compound as a sorbent. There are a wide variety of such compounds known, many having been developed for hydrogen purification, or storage, and thus have already been characterized for hydrogen absorption and desorption and are capable of storing 1,200× their own volume in hydrogen. Thousands more structures can be designed to be within the scope of this invention. Compounds have been characterized with a wide range of gas capacities and pressure or temperature sensitivities. In one configuration the MOF could be used as an alternative to the Pd currently used to store excess (or make-up) hydrogen within the pump.

An advantage to using a MOF sorbent is that it enables the use of gases other than hydrogen. Other compounds with large capacities for $CO_2$, as well as work with oxygen, nitrogen, and methane among others, can be used with the present invention.

New pumping mechanisms using metal organic framework sorbents (MOFS).

Although the MOF can be used in the same way as a metal or alloy the use of an MOF opens up other approaches as well. In all cases the ambient gas pressure in equilibrium with the solid is a function of temperature. A pump solely using gas adsorption/desorption on an MOF can be constructed. Such a device would be membrane free, can be comprised only of a cylinder with an MOF sorbent at one end with free access to an open volume (head space) having a piston at the opposite end with the fluid to be pumped on the opposite side of the piston.

This would be a thermally controlled device. The pumping cycle would be as follows (starting with all of the gas stored on the MOF): As illustrated FIGS. 26A to 26C, a heating the portion of the cylinder with the MOF in it raises the equilibrium pressure for the gas. The increasing gas pressure advances the piston. When the piston has moved sufficiently (or reaches the end of its travel) cooling the MOF lowers the equilibrium gas pressure and triggers the re-adsorption of the gas. This pulls the piston back to its original position (assuming there is pressure on the other side of the piston) to start the cycle over.

A thermally driven pump using MOF's to store gas has several potential advantages, including the ability of use gases other than hydrogen. (Using a gas with a larger molecular radius reduces the rate permeation of working gas out of the pump.) With a thermally driven system it is possible to use waste heat from elsewhere in the system containing the pump to drive the pump for a gain, possibly significant, in overall efficiency. The exact gain is dependent on the system design.

Figure 26:
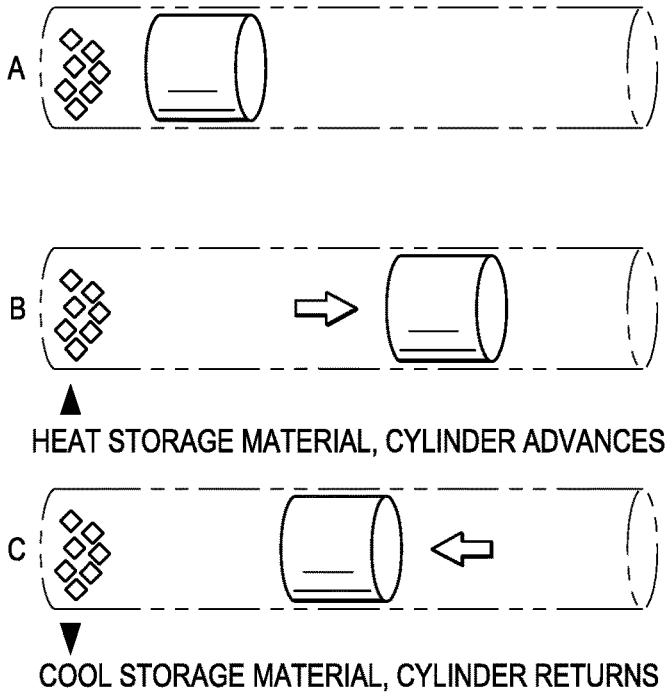
FIG. 26 is a diagram that shows steps A, B and C, in which heating a portion of the cylinder with the metal organic framework (MOF) in it raises the equilibrium pressure for the gas and cooling it lowers the equilibrium pressure.

FIG. 26 shows the cycling of a thermally driven pump using a MOF as the gas storage medium. Part A of FIG. 26 shows the initial position at the start of the pumping cycle. FIG. 26 part B shows a heating the portion of the cylinder with the MOF in it raises the equilibrium pressure for the gas. The increasing gas pressure advances the piston. FIG. 26 part C shows when the piston has moved sufficiently (or reaches the end of its travel) cooling the MOF lowers the equilibrium gas pressure and triggers the re-adsorption of the gas. This pulls the piston back to its original position (assuming there is pressure on the other side of the piston) to start the cycle over.

Moving hydrogen gas from one side of a membrane to another isn't the only way to use hydrogen to actuate a pump. An alternative way to supply and control the volume of hydrogen gas to actuate the pump is to utilize the chemistry behind a nickel-hydrogen battery where the hydrogen is stored in a solid with a relatively low molar volume (45.2 mL per mole of $H_2$ vs. 22.4 L per mole of $H_2$ in the gas phase (at STP), or a reduction by a factor of nearly 500) when the cell is in the discharged state and electrochemically converted to gas when the $Ni(OH)_2$ is reduced during charging. The equations for a nickel-hydrogen battery follow.

This battery chemistry has been used for decades and is a primary part of the batteries used in many satellites. In one non-limiting embodiment, a nickel-hydrogen cell can be preferred because it weighs less per Amp-hour than either a nickel-metal hydride cell or a nickel-cadmium cell, an important feature when the cost of launching into orbit is a significant factor, but because hydrogen is typically stored as a compressed gas when the cell is charged, the volume required per Amp-hour is greater. The presence of gaseous hydrogen also makes this type of battery less desirable in consumer applications. The net chemistry for this cell is as shown below with the charged form on the left:

$$\tfrac{1}{2}H_2 + NiOOH \leftrightarrow Ni(OH)_2$$

The two separate reactions are (Ni electrode, always solid):

$$NiOOH + H_2O + e^- \leftrightarrow Ni(OH)_2 + OH^-$$

and (hydrogen electrode, high volume when charged, low volume when discharged):

$$\tfrac{1}{2}H_2 + OH^- \leftrightarrow H_2O + e^-$$

As noted above, both electrode equations have the charged state on the left.

The hydrogen electrode can be any reversible hydrogen electrocatalyst (Pt, Ir, Pd, etc.,) including (since this is an alkaline system) Ni metal with the exact choice used in a pump being a factor of the pumps application. (A Pt electrode will give better performance, including higher gas generation rates, but will be more costly than a Ni one.) The nickel electrode consists of a porous sintered nickel structure with the porosity filled with nickel(II) hydroxide that is oxidized to nickel(III) oxy-hydroxide (NiOOH) during charging. The two electrodes are separated by a hydroxyl conducting electrolyte (either an anion conducting membrane or a porous support with the pores filed with an alkaline solution). The former solution is the more effective for this application since it produces a device without liquid electrolyte present but the latter is less expensive.

In operation charging the battery generates hydrogen with full rate control by controlling the current flow into the cell. Charging the cell pushes the pump forward as hydrogen gas (high volume) is produced from the low volume solid. Discharging this secondary cell, also controlled by controlling the current flow, pulls the hydrogen back out of the gas phase into the solid phase. Using the electrical output from the cell (when it is being discharged and the amount of hydrogen in the gas phase reduced) as a source of power is a form of energy recovery.

In a pumping device designed to maintain a steady flow by using a set of two or more synchronized pump actuators using the discharge power from one cell to furnish most of the power to charge another one can lead to a very energy efficient pump. Individually Ni—H cells have roundtrip efficiencies greater than 80%.

Figure 27:
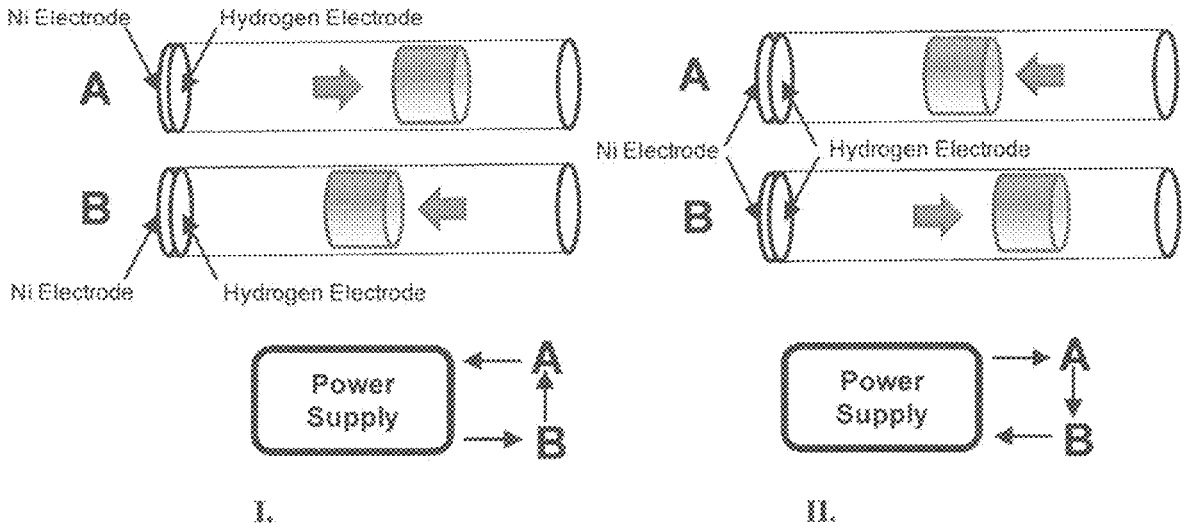
FIG. 27 shows the efficiency gains of coupling pumps using nickel hydrogen batteries prime movers are achieved by using the energy released by one cell while discharging as part of the energy to recharge the other.

FIG. 27 shows that the efficiency gains of coupling pumps using nickel hydrogen batteries prime movers are achieved by using the energy released by one cell while discharging as part of the energy to recharge the other. In FIG. 27 (i) above cell b is discharging with its output augmented by a power supply to charge a. In FIG. 27 (ii) this process is reversed. In FIG. 27, on the left side (I) top the cell at the base of A is charging and producing hydrogen to drive a piston forward. Most of the power to charge it comes from B, which is discharging and drawing its piston back with the remainder of the power needed to charge (drive) A coming from an external power supply (at bottom). On the right side (II) the process is reversed. The cell at the base of B is charging and producing hydrogen to drive a piston forward. Most of the power to charge it comes from A, which is discharging and drawing its piston back with the remainder of the power needed to charge (drive) B coming from an external power supply (at bottom). Having the cells operate in parallel ensures that the rate of fluid motion stays steady in both.

Harnessing the energy stored during the delivery stroke of one cylinder and released when the cylinder returns to actuate another cylinder can reduce the energy requirements of the pump by 80%. This is especially valuable for a battery-powered system (i.e., a system where the power supply in the lower portion of FIG. 27 is a battery).

This system is intended to be used where it is desired to continuously pump a fluid from one point (e.g., a reservoir) to another. It is assumed that the portions of the pumps in contact with to the fluid being moved will be interconnected using a set of check valves to ensure one-way flow. Such schemes are well known in the art and need not be described here. The skilled artisan will recognize that the same basic approach may be taken with three, four, or more pumps acting in parallel or in a controlled sequence to maintain an even more stable flow rate.

One clear advantage of this chemistry over ones that use either a metal (i.e., Pd) or alloy (e.g., $LaNi_5$) for low volume hydrogen storage is that no ambient hydrogen pressure is required to keep the hydrogen in the solid state. $Ni(OH)_2$ is stable under any useful pressure until it is electrochemically oxidized.

Multiple cells can be connected to the hydrogen chamber of the same pump with the cells connected either in series or in parallel. If a loss of hydrogen from the pump is expected, it can be compensated for in the design phase by starting with excess $Ni(OH)_2$ in the nickel electrode so replacement hydrogen is available. (In principle a large amount of extra hydrogen can be included this way.) This method of storing hydrogen is effectively using a battery with more Amp-hours of capacity than is strictly required for the desired pumping capacity.

Hydrogen Management.

In a further embodiment, an electrolyzer is disposed to produce hydrogen gas into the first or second driving fluid chamber, which may be used in conjunction with any of the configurations taught in, e.g., FIGS. 14 to 18. The electrolyzer preferably produces hydrogen gas from water stored within the electrolyzer membrane. Optionally, a controller operates the electrolyzer to replace hydrogen gas that leaks out of the first and second driving fluid chambers, optionally in accordance with a gas pressure sensor or by measuring the stroke length. In an optional embodiment, a metal/air electrochemical cell or battery may be disposed to consume oxygen gas produced as a byproduct of producing hydrogen gas with the electrolyzer.

In a further embodiment, a metal hydride alloy, MOFS or similar material is disposed to store hydrogen gas within the electrochemical actuator. The hydrogen can be reversibly moved between the metal hydride and the first or second driving fluid chamber through either gas phase or electrochemical methods.

Due to its small molecular size, hydrogen permeates through most materials. Hermetically sealing the hydrogen within a device, such as an electrochemical actuator, for more than a few years is problematic. According to another embodiment of the invention, one solution is to create the hydrogen in the actuator when it is first needed and then replenish the hydrogen as it is lost. One method of hydrogen generation is via electrolysis of water to produce hydrogen and oxygen gas. Another embodiment is to use the Ni—H battery chemistry described above.

The amount of hydrogen in the electrochemical actuator can be determined by the time taken to drive all the hydrogen from one chamber to another. The voltage required to drive hydrogen from one chamber will be low until there is little hydrogen left to drive across the membrane electrode assemblies. When hydrogen is scarce, the voltage required to drive the same current will be much higher. If it is determined that the amount of hydrogen in the pump has diminished it can be replenished from the hydrogen source, such as an electrolyzer, that is in communication with one or multiple chambers of the pump.

Electrolysis can be performed in a separate electrolyzer or in one or more of the electrochemical cells of the electrochemical hydrogen pump. Water for electrolysis can be stored in the electrochemical membrane of the electrolyzer. Water stored in the electrochemical hydrogen pump can also be used for electrolysis since the water will diffuse between the membranes.

The oxygen gas generated by the electrolyzer must be removed to prevent it from recombining with the hydrogen gas. One option is to vent the gas through a check valve, as shown in FIG. 14, but this option is not ideal for long life pumps since the water contained in the electrochemical hydrogen pump and electrolyzer will eventually be lost. Since check valves do not seal perfectly, water vapor will escape through the check valve during storage. During operation, water vapor will be lost as the oxygen is purged.

As described hereinabove, FIG. 15 is a schematic diagram of an electrochemical actuator in the form of an electrochemical hydrogen pump with one electrode in direct communication with a driving fluid bellows, an electrolyzer for adjusting the amount of hydrogen gas available to the electrochemical hydrogen pump, and a metal/air battery for consuming oxygen from the electrolyzer. A second method of removing the oxygen gas is to consume it in a metal/air battery, for example Zn/air, Li/Air, Fe/air, etc., as shown in FIG. 15. By placing a load across the battery when oxygen gas is present, current will be drawn from the battery and the oxygen gas will be consumed.

As described hereinabove, FIG. 16 is a schematic diagram of an electrochemical actuator in the form of a electrochemical hydrogen pump with one electrode in direct communication with a driving fluid bellows, an electrolyzer for adjusting the amount of hydrogen gas available to the electrochemical hydrogen pump, and a metal/air electrochemical cell for consuming oxygen from the electrolyzer. A third method of removing the oxygen gas is to consume it in a metal/oxygen electrochemical cell, for example Ni/air, as shown in FIG. 16. This has the benefit that the total potential of the metal/air cell is too high for spontaneous hydrogen evolution. The nickel oxidation reaction is driven by applying a potential across the cell when oxygen gas is present. In some situations pump performance can be improved by reducing hydrogen pressure to an optimal level. This can be achieved by charging the metal/air battery or reversing the metal/oxygen electrochemical cell to generate oxygen gas. The oxygen will react with the hydrogen to form water.

According to another embodiment of the invention, any hydrogen lost is replenished with hydrogen stored within a metal hydride alloy material. The hydrogen can be extracted from the metal hydride through either gas phase or electrochemical means. This method also allows the hydrogen pressure within the device to be controllably increased or decreased by releasing or storing hydrogen within a metal hydride alloy.

As described hereinabove, FIG. 17 is a schematic diagram of a pump assembly including metal hydride for the release of hydrogen. An electrochemical hydrogen pump can be used to move hydrogen gas from a chamber in which the metal hydride is stored and into the electrochemical actuator, thereby increasing the hydrogen pressure within the electrochemical actuator. The low hydrogen pressure created around the metal hydride alloy will result in the release of hydrogen from the metal hydride. The hydrogen pressure within the electrochemical actuator can be decreased by using an electrochemical hydrogen pump to move hydrogen from the actuator into a chamber in which the metal hydride alloy is stored. The increased hydrogen gas pressure about the hydride will result in hydrogen being absorbed by the metal hydride alloy.

As described hereinabove, FIG. 18 is a schematic diagram of a pump assembly including an alkaline metal hydride electrolyzer during operation to release hydrogen. Electrochemical release of hydrogen from the metal hydride can be achieved using the alkaline electrolyzer. Water is electrolyzed at the cathode to form hydrogen gas and OH ions. At the anode, the OH ions combine with hydrogen from the metal hydride to form water. This system has the benefit that it does not generate any oxygen so does not require the added complexity of an oxygen absorption system.

As described hereinabove, FIG. 19 is a schematic diagram of the pump assembly in FIG. 18 during operation to store hydrogen. Electrochemical storage of hydrogen is achieved by electrolyzing water at the metal hydride alloy, which acts as a catalyst to form $OH^-$. The $H^+$ ions formed in the reaction attach to the metal hydride alloy. At the anode the OH ions combine with hydrogen gas to form water.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

REFERENCES

T. R. Cook, Y.-R. Zheng, and P. J. Stang, Chemical Reviews, 113 (1) 734-777 (2013)

D. Zhao, D. Yuan, and H.-C. Zhou, Energy & Env. Sci., 1, 222-235 (2008).

N. Stock and S. Biswas, Chemical Reviews, 112 (2) 933-969 (2012).

B. Silva, I. Solomon, A. M. Ribeiro, U-H. Lee, Y. K. Hwang, J.-S. Chang, J. M. Loureiro, A. E. Rodrigues, Sep. and Purif. Tech., 118, 744-756 (2013).

J.-R. Li, J. Sculley, and H.-C. Zhou, Chemical Reviews, 112 (2) 869-932 (2012).

H. Furukawa, M. A. Miller, and O. Yaghi, J. Mat. Chem., 17, 3197-3204 (2007).

C. E. Wilmer, M. Leaf, C. Y. Lee, O. K. Farha, B. G. Hauser, J. T. Hupp, and R. Q. Snurr, Nature Chem., 4, 83-89 (2012).

D. Liu, W. Wang, J. Mi, C. Zhong, Q. Yang, and D. Wu, I&EC Res., 51 (1) 434-442 (2012).

C. Yang, X. Wang, and M. A. Omary, Journal of the American Chemical Society, 129, 15,454-15,455 (2007).

D. Frahm, M. Fischer, F. Hoffmann, and M. Fröba, Inorg. Chem., 50 (21) 11,055-11,063 (2011).

S. Ma, X.-S. Wang, C. D. Collier, E. S. Manis, and H.-C. Zhou, Inorg. Chem., 46, 8499-8501 (2007).

What is claimed is:

1. A pump head operable with a driving fluid, comprising:

a pump housing including a moveable element that separates a driving fluid chamber from a pumping fluid chamber, an inlet check valve disposed to allow unidirectional fluid communication of a pumping fluid into the pumping fluid chamber, and an outlet check valve disposed to allow unidirectional fluid communication of the pumping fluid out of the pumping fluid chamber;

first and second control valves in fluid communication with the driving fluid chamber and selectively operable to establish the driving fluid chamber in fluid communication with a driving fluid source or vacuum;

wherein the moveable element is a rigid plate, the driving fluid chamber includes a first expandable bellows secured between a driving fluid chamber surface of the rigid plate and a first side of the pump housing, and the pumping fluid chamber includes a second expandable bellows secured between a pumping fluid chamber surface of the rigid plate and a second side of the pump housing;

wherein the first and second expandable bellows define an axial direction of expansion and retraction; and wherein the first and second expandable bellows each have a cross-sectional area in a plane perpendicular to the axial direction, wherein a cross-sectional area inside the first expandable bellows is less than a cross-sectional area inside the second expandable bellows;

wherein the pump housing is open to the atmosphere around the circumferential exterior surfaces of the first and second expandable bellows facing away from the interiors of the first and second expandable bellows and parallel to the axial direction of expansion and contraction, wherein an atmospheric pressure of the atmosphere acting on the larger cross-sectional area of the second expandable bellows assists in pressurizing and displacing the pumping fluid from the second expandable bellows and impedes drawing of the pumping fluid into the pump fluid chamber, thereby requiring a reduced vent or vacuum pressure to fully expand the second expandable bellows; and a spring disposed concentric to and outside of the first expandable bellows between the driving fluid chamber surface of the rigid plate and the first side of the pump housing, wherein the spring biases the first expandable bellows to expand in the axial direction.

2. The pump head of claim 1, wherein the driving fluid comprises hydrogen, methane, natural gas, propane, or one or more other gases.

3. The pump head of claim 1, wherein the pumping fluid comprises a gas or a liquid.

4. The pump head of claim 1, wherein the pump head is coupled in fluid communication with an electrochemical actuator.

5. The pump head of claim 4, wherein the electrochemical actuator is hermetically sealed within a material with a very low permeability to hydrogen.

6. The pump head of claim 5, wherein the material is aluminum.

7. An electrochemically actuated pump comprising:

at least one pump head of claim 1; and an electrochemical actuator coupled in fluid communication with the at least one pump head.

8. The electrochemically actuated pump of claim 7, wherein the driving fluid comprises hydrogen, methane, natural gas, propane, or one or more other gases.

9. The electrochemically actuated pump of claim 7, wherein the pumping fluid comprises a gas or a liquid.

10. The electrochemically actuated pump of claim 7, wherein the electrochemical actuator is hermetically sealed within a material with a very low permeability to hydrogen.

11. The electrochemically actuated pump of claim 10, wherein the material is aluminum.

12. The electrochemically actuated pump of claim 7, wherein the electrochemical actuator comprises a metal hydride alloy material disposed to store hydrogen gas within the electrochemical actuator.

* * * * *